US005272275A

United States Patent [19]

Kunimoto

[11] Patent Number: 5,272,275

[45] Date of Patent: Dec. 21, 1993

[54] BRASS INSTRUMENT TYPE TONE SYNTHESIZER

[75] Inventor: Toshifumi Kunimoto, Hamamatsu, Japan

[73] Assignee: Yamaha Corporation, Hamamatsu, Japan

[21] Appl. No.: 864,632

[22] Filed: Apr. 7, 1992

[30] Foreign Application Priority Data

Apr. 10, 1991 [JP] Japan ..... 3-104805

[51] Int. Cl.[5] ..... G10H 1/12

[52] U.S. Cl. ..... 84/661; 84/DIG. 9; 84/DIG. 10; 331/78

[58] Field of Search ..... 84/622-625, 84/661, 699, 700, 736, DIG. 9, DIG. 10; 331/78

[56] References Cited

U.S. PATENT DOCUMENTS 4,736,663 4/1988 Wawrzynek et al. ..... 84/DIG. 10
4,984,276 1/1991 Smith .

FOREIGN PATENT DOCUMENTS 393703 4/1990 European Pat. Off. .
2-294692 12/1990 Japan .
2-294693 12/1990 Japan .
3-121498 4/1991 Japan .
3-119393 5/1991 Japan .
3-186897 8/1991 Japan .

OTHER PUBLICATIONS

"On The Oscillations Of Musical Instruments", McIntyre, et al, J. Acoust, Soc. Am. 74 (5), Nov. 1983, pp. 1325-1345.

"Lip Vibrations In A Cornet Mouthpiece", Daniel W. Martin, J.A.S.A., Jan., 1942, vol. 13, pp. 305-308.

"Excitation Mechanisms In Woodwind And Brass Instruments", N. H. Fletcher, Acustica, vol. 43, 1979, pp. 63-72.

"Musical Acoustics Study Meeting", Yoshikawa, Mar. 8, 1986, vol. 4, No. 7, pp. 25-34.

*Primary Examiner*—Stanley J. Witkowski
*Attorney, Agent, or Firm*—Graham & James

[57] ABSTRACT

A tone signal synthesizer for simulating musical tones of a brass instrument faithfully. A nonlinear portion and a pipe linear portion are combined to simulate a brass instrument. The nonlinear portion has a resonance circuit having a resonance frequency in the vicinity of the frequency of a musical tone on the basis of an upper model, and a resonance circuit having a low resonance frequency on the basis of an outer model. Not only oscillation in the frequency of the musical tone is made by the former, but the instability of a brass instrument upon starting of tone generation is simulated by the latter. Further, not only a random number generation circuit gives a random number component to a flow rate signal, but a function table and a multiplier make the level of the random number component proportional to the square root of the flow rate signal.

18 Claims, 20 Drawing Sheets

WITH LOCAL FEEDBACK

WITHOUT LOCAL FEEDBACK

INPUT/OUTPUT RELATION
WITH LIMIT FUNCTION

9

BRASS INSTRUMENT TYPE TONE SYNTHESIZER

BACKGROUND OF THE INVENTION

1. Field of the Invention

The present invention relates to a musical tone synthesizer suitable for simulating a brass instrument.

2. Description of the Related Art

A method for synthesizing a musical tone of an acoustic instrument by operating a model simulating the tone generating mechanism of the acoustic instrument is known. In particular, a closed loop structure model constituted by connecting a nonlinear amplification element for simulating the elastic characteristic of a reed and a bidirectional transmission circuit for simulating a resonator is known as a basic model of a brass instrument such as clarinet. In this type model, a backward or reflected wave signal is added to a signal outputted from the nonlinear amplification element, and then the resultant signal is supplied, as a forward or advancing wave signal, to the bidirectional transmission circuit.

Then, the forward wave signal is reflected at a terminal portion of the bidirectional transmission circuit, so that the reflected signal propagates on the bidirectional transmission circuit in the reverse direction. Thereafter, the reflected signal is added to the forward wave signal and fed back to the nonlinear amplification element (excitation circuit). As a result, the propagation of an air pressure wave on the brass instrument is simulated by a closed loop circuit composed of the nonlinear amplification circuit and the bidirectional transmission circuit.

Some acoustic brass instruments have holes for pitch control which are so called "tone holes". A model for simulating the brass instrument inclusive of the tone holes is also known. In this type model, signal processing circuits called "signal scattering junctions" (hereinafter merely called "junctions") are interposed between bidirectional transmission circuits correspondingly to the tone holes. The junctions respectively carry out arithmetic operations such as multiplying input signals from adjacent bidirectional transmission circuits by coefficients, so that the results of the arithmetic operations are respectively supplied to the adjacent bidirectional transmission circuits. In the arithmetic operations, multiplication coefficients and the like are respectively switched corresponding to the opening/closing conditions of the tone holes.

In this case, a signal fed back to the nonlinear amplification element is the sum of components turning back at the respective junctions. Further, as described above, multiplication coefficients for arithmetic operations at the respective junctions are switched corresponding to the opening/closing conditions of the tone holes, so that frequency characteristics of transmission in the bidirectional transmission circuit side seen from the nonlinear amplification element side are switched corresponding to the opened/closed conditions of the tone holes.

In the frequency characteristic of transmission, a plurality of peaks are formed as resonance frequencies composed of a fundamental frequency corresponding to the delay time which it takes for an output signal from a nonlinear amplification element to be propagated through the transmission circuit, to be reflected at a junction corresponding to an opened tone hole and be fed back to the nonlinear amplification element, and harmonic frequencies which are integral multiples of the fundamental frequency. This type of technique has been disclosed in U.S. Pat. No. 4,984,276.

The aforementioned technique is aimed to simulate a woodwind instrument. There is no model known for simulating a brass instrument (lip-reed instrument). In the brass instrument, various parameters for a musical tone are controlled by the lip condition of a player. The brass instrument has instability peculiar at the time of the rising of the musical tone. Further, the brass instrument has a characteristic in which the musical tone contains a lot of harmonic components. Because of these characteristics, a musical tone generated by an electronic musical instrument is inclined to be unnatural as brass instrument tones if these characteristics cannot be reflected on the musical tone.

SUMMARY OF THE INVENTION

An object of the present invention is to provide a tone synthesizer which can simulate musical tones of a brass instrument faithfully.

According to an aspect of the present invention, there is provided loop circuit means having a loop circuit; pressure difference means, connected at at least one point in said loop circuit and receiving a breath signal expressing a breathing pressure and a pressure signal expressing a loop pressure which is a signal in said loop circuit, for outputting to said loop circuit a signal corresponding to a pressure difference between said breathing pressure and said loop pressure; resonance means including a first and a second circuit, which constitutes part of said loop circuit, said first circuit generating a first signal which becomes smaller as an absolute value of said pressure difference becomes larger, and said second circuit generating a second signal which becomes larger as the absolute value of said pressure difference becomes larger; transmission means for transmitting a transmission signal based on said first and second signals on said loop circuit; and junction means for making a short-cut of said loop circuit on which part of said transmission signal passes.

As the player's breathing pressure detected by the breathing pressure detection means increases, the random number component given to the breathing pressure signal by the random number level control means increases. Accordingly, variation in pitch of a musical tone generated correspondingly to a large amount of breathing pressure in an acoustic brass instrument is simulated.

According to another aspect of the present invention, there is provided a tone synthesizer comprising: breathing pressure detection means for detecting a breathing pressure; pressing force detection means for detecting a pressing force; frequency control means for increasing a frequency of a tone signal to be synthesized in accordance with said pressing force; random component addition means for adding a random number component to said frequency; and random number control means for increasing said random number component in accordance with said breathing pressure.

According to another aspect of the present invention, there is provided a tone synthesizer comprising: performance manipulator adapted to be played by a player by applying a breathing pressure of said player and a pressing force with a lip of said player; breathing pressure detection means for detecting said breathing pressure; pressing force detection means for detecting said pressing force; first resonance means for imparting to an input signal supplied thereto a first resonance characteristic which changes in accordance with said breathing pressure and said pressing force and outputting, as a first resonance signal, said signal to which said first resonance characteristic is imparted; and delay means for delaying said first resonance signal and for feeding said delayed first resonance signal back to said first resonance means as said input signal.

The breathing pressure of the player and the pressing force of the lips of the player are respectively detected by the breathing pressure detection means and the pressing force detection means, so that the resonance characteristic of the first resonance means changes correspondingly. Accordingly, a change is given to a tone signal correspondingly to the breathing pressure and the pressing force.

The tone synthesizer may further comprise a second resonance means having a resonance frequency in the vicinity of the frequency of a musical tone, and a third resonance means having a low resonance frequency.

Because the second resonance means having a resonance frequency in the vicinity of the frequency of a musical tone and the third resonance means having a low resonance frequency are further provided, not only the frequency of the musical tone is determined by the second resonance means and the delay means but the unstable vibrating state at the time of the rising of tone generation is simulated by the third resonance means.

The aforementioned tone synthesizer can simulate musical tones of a brass instrument faithfully.

The present invention will be described hereunder with reference to the accompanying drawings in connection with preferred embodiments of the present invention.

DESCRIPTION OF THE PREFERRED EMBODIMENTS

Embodiments of the present invention will be described hereunder with reference to the drawings.

A. Theory as Prerequisite for Embodiments

A.1 Physical Model of Brass Instrument

Figure 2A:
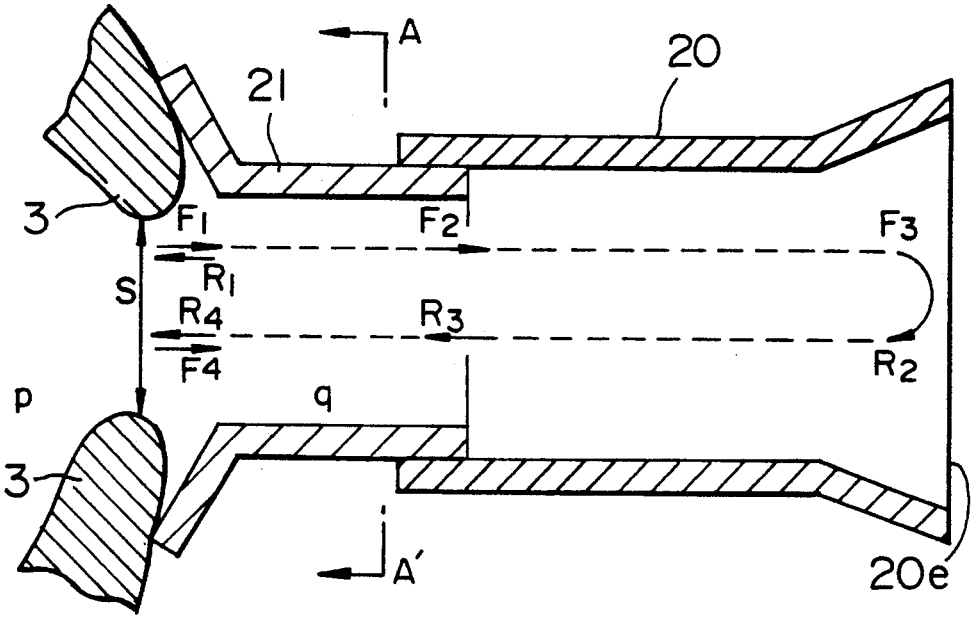
FIGS. 2A to 4 are diagrams showing principles of the operation of a brass instrument.
Figure 2B:
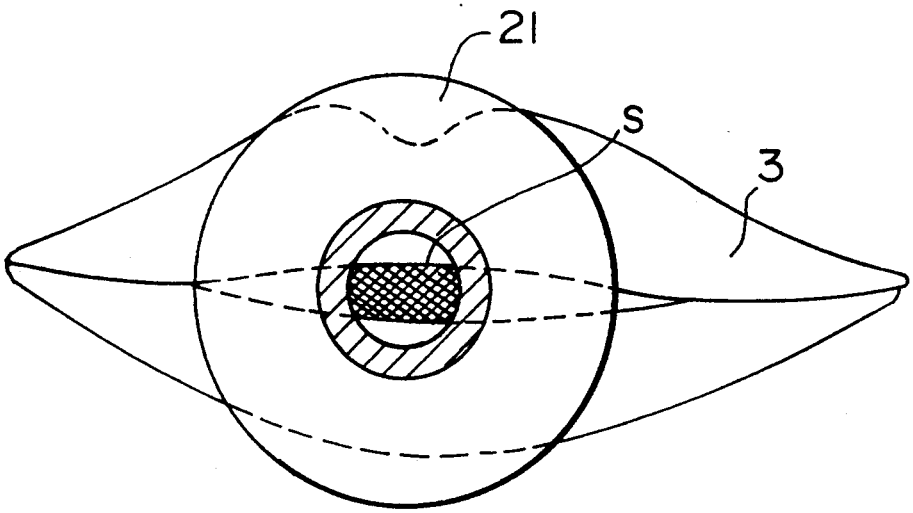

An electronic brass instrument in this embodiment is intended to simulate the tone generating mechanism of an acoustic brass instrument. A physical model of an acoustic brass instrument will be described with reference to FIGS. 2A and 2B. The physical model as shown in FIGS. 2A and 2B is formed by applying the movement of lips in a brass instrument (lip-reed instrument) to a model of a woodwind instrument proposed by M. E. Mcintyre et al (M. E. Mcintyre, R. T. Schmacher, J. Woodhouse "On the oscillations of musical instruments", J. Acoust. Soc. Am. 74(5), November 1983, 0001-4966/83/111325-21$00.88, 1983 Acoustic Society of America).

In FIG. 2A, a mouthpiece 21 is inserted into a resonance pipe 20 in a brass instrument. Player's lips 3 are pushed against the mouthpiece 21. When a player gives out breath into the mouthpiece 21, pressure just under the lips 3 changes so that a flow f is generated correspondingly to the nonlinear characteristic of the lips 3. The pressure change caused by the flow f is added with an instantaneous rearward pressure wave R1 to form a forward pressure wave F1. The forward pressure wave F1 propagates toward a terminal portion 20*e* of the resonance pipe 20.

Then, the forward pressure wave F1 propagates while being reflected at various points, so that the wave changes to forward waves F2 and F3 with the passage of time. Then, the forward pressure wave F3 is reflected at the terminal portion 20e. Then, the reflected wave R2 propagates toward the lips 3. The reflected wave R2 also propagates while being reflected at various points, so that the wave changes to reflected waves R3 and R4 with the passage of time before it turns back to the lips 3. A result obtained by adding the instantaneous forward wave F4 to the reflected wave R4 forms pressure q just under the lips 3. As the difference (hereinafter called "pressure difference Ph") between air pressure p (breathing pressure) in the oral or buccal cavity and air pressure q (pressure based on the reflected wave R) in the mouthpiece 1 increases, the inflow velocity increases.

FIG. 2B is a sectional view taken along the line A—A' in FIG. 2A. In FIG. 2B, the cross-hatched portion shows a slit (opening area) S.

Figure 14:
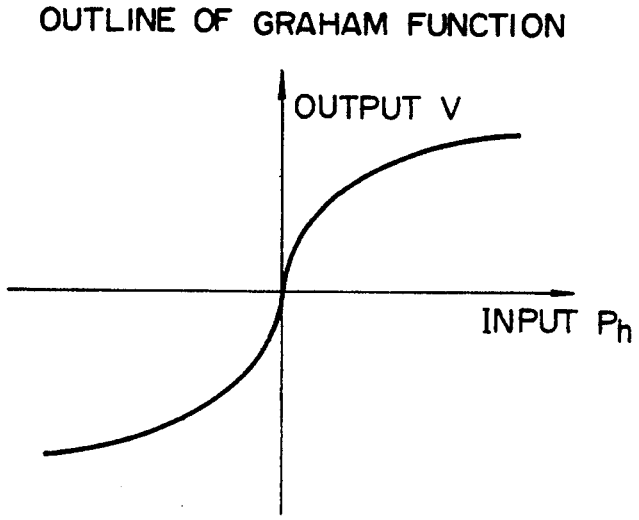
FIG. 14 is a graph showing an outline of Graham function.

According to Graham's rule, a flow rate (air velocity v) in unit area in unit time is given by the following equation (A1) for $p \geqq q$:

$$v=\sqrt{\{2(p-q)/\rho\}}=L(Ph) \quad \text{(A1)}$$

in which $\rho$ represents air density. The volumetric flow rate f is equal to a value obtained by multiplying the air velocity v by the area of slit S. The relation given by equation (A1) is plotted as shown in FIG. 14.

A.2 Physical Model of Lips 3

In FIG. 2A, when the reflected wave R4 reaches the lips 3, it is fed back to the vibration of the lips 3 so as to contribute to the steady-state oscillation of the lips 3. This mechanism is given by the following two representative models.

(1) Outer Model

Figure 3:
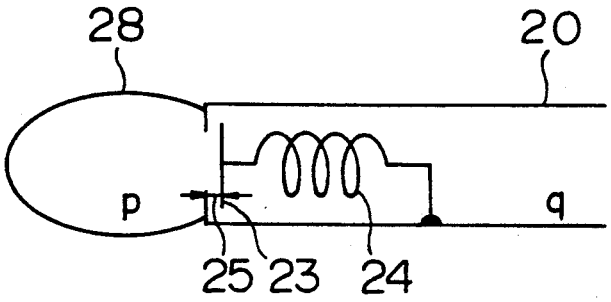

According to the article written by Martin (Daniel W. Martin: "Lip Vibrations in a Cornet Mouthpiece", J. Acoust. Soc. Am., Vol. 13, 1942), the article written by Fletcher (N. H. Fletcher: "Excitation Mechanism in Woodwind and Brass Instruments", Acustica, Vol. 43, 1979) and the like, it has been explained that lip vibrations are caused by breathing pressure acting to forcedly open the lips 3 in the inside of the mouthpiece 21. According to the theory described in these articles, a physical model of lips 3 can be approximated as shown in FIG. 3. In this model, a piston 23 is provided so as to be lengthwise movable. The piston 23 is connected to the resonance pipe 20 through a spring 24. The piston 23 is equivalent to the lips 3. The piston 23 is urged toward the original position by the spring 24 when it moves left and right from the current position shown in FIG. 3. The sectional area of the remaining aperture at the position in which the distance 25 between the piston 23 and the resonance pipe 20 is minimized is equivalent to the slit S (see FIGS. 2A and 2B).

Figure 5A:
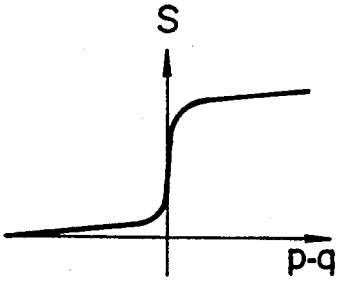
FIGS. 5A to 5C are graphs showing characteristics physical quantities in a brass instrument as a function of pressure difference.

In this model, the distance 25 increases as the difference (p−q) between breathing pressure p applied from the buccal cavity 28 and air pressure q in the mouthpiece increases. Further, it is apparent when the air pressure q increases greater than p by more than some degree, that the distance 25 disappears perfectly, and that the motion of the piston 23 has little influence on the change of the distance 25 even if the breathing pressure p increases to some degree. As described above, the slit S can be expressed as a function S(p−q) of pressure difference (p−q). This function is called "slit function". The slit function S in the outer model has characteristic as shown in FIG. 5A.

(2) Upper Model

Figure 4:
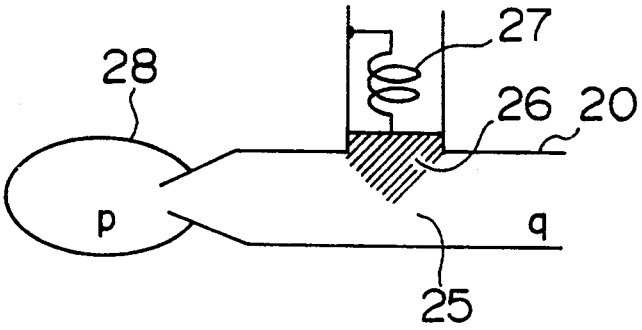

On the other hand, according to the article written by Yoshikawa (Shigeru Yoshikawa: "Problems on Tone Generating Mechanisms of Wind Instruments", Materials of The Musical Acoustics Study Meeting, March 1986), the oscillation theory is explained by the phenomenon that Bernoulli's pressure is produced between upper and lower lips on the basis of breathing flow pressure caused by breathing pressure and acts on the upper and lower lips to purse them as pressure difference increases. According to this theory, a physical model of lips 3 can be represented as shown in FIG. 4. In FIG. 4, a piston 26 is suspended down through a spring 27, so that the piston 26 can be moved up and down by the Bernoulli's pressure in the resonance pipe 20. The terminology "Bernoulli's pressure" herein used means pressure which is produced by a flow velocity and perpendicularly to the flow velocity and takes a larger value as the flow velocity increases.

The physical model shown in FIG. 4 is constructed on the following assumptions:

(a) The lip area exposed to Bernoulli's pressure is little affected by the lip opening: and (b) There is no great difference between the case where upper and lower lips are disposed and the case where an upper lip alone is disposed (upper and lower lips move symmetrically).

The aforementioned assumptions (a) and (b) based on the article written by Yoshikawa have been proved as reasonable by experiments.

Bernoulli's pressure $P_B$ is given by the following equation (A2).

$$P_B=-(\rho/2)|2(p-q)/\rho| \quad \text{(A2)}$$

Figure 5B:
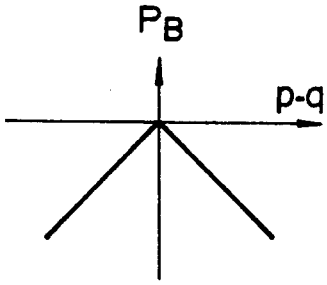
Figure 5C:
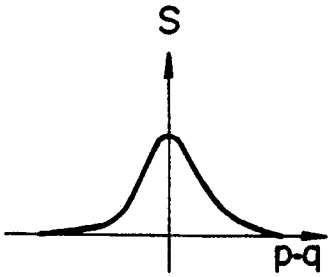

According to the equation (A2), the relation between the pressure difference (p−q) and the Bernoulli's pressure $P_B$ is as shown in FIG. 5B. Further, the relation between the Bernoulli's pressure $P_B$ and the slit S is as shown in FIG. 5A, so that the relation between the pressure difference (p−q) and the slit function S is as shown in FIG. 5C. It is apparent from FIG. 5C that the air flow velocity increases as the pressure difference (p−q) increases and, accordingly, the slit function S decreases as the pressure difference (p−q) increases. That is, in the upper model, a conclusion reverse to that in the outer model is led out.

In an acoustic brass instrument, oscillation is made by both the action of the upper model and the action of the outer model. It is considered that the former's contribution to oscillation is greater than the latter's contribution. This will be described more in detail with reference to FIG. 12.

Figure 12:
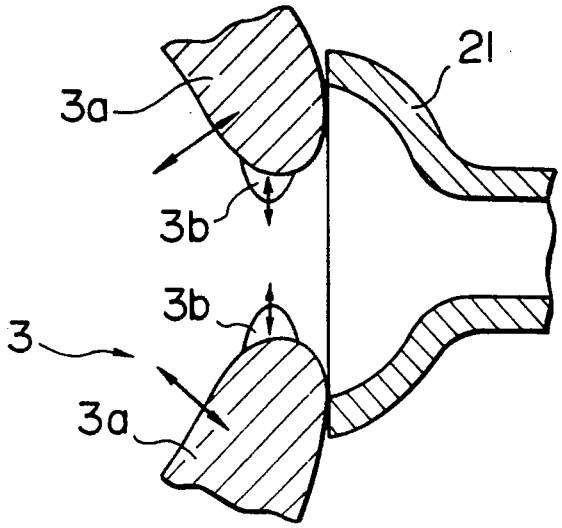
FIG. 12 is a diagram showing the vibrating condition of lips 3.

In FIG. 12, the upper and lower lips are constituted by an outer reed portion 3a vibrating on the basis of the outer model and an upper reed portion 3b vibrating on the basis of the upper model. The outer reed portion 3a has relatively large mass, so that it has a large time constant. The upper reed portion 3b is disposed with a small mass on the outer reed portion 3a, so that the upper reed portion 3b moves relatively when the outer reed portion 3a is driven outward to be forcedly opened.

Here, it is considered that the outer reed portion 3a relatively slowly moves compared with the upper reed portion 3b because the outer reed portion 3a has a larger time constant. That is, it is considered that the vibration frequency is about 30 Hz and has no direct influence on the pitch of the musical tone. Accordingly, it is considered that the initial slit S of the lips 3 in the vibrating condition of the upper reed portion 3*b* in the pitch frequency is given by the outer reed portion 3*a*. Consequently, the real slit S of the lips 3 in the playing condition is given by the sum of the displacement of the outer reed portion 3*a* and the displacement of the upper reed portion 3*b*.

A.3 Whole Structure of Physical Model Tone Generator

Figure 6:
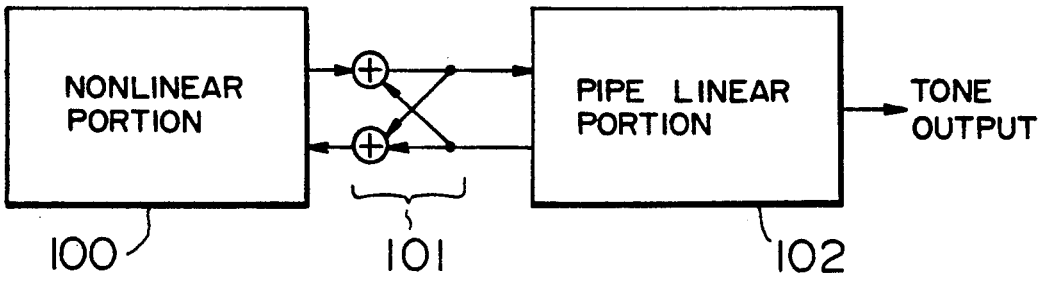
FIG. 6 is a block diagram showing the whole structure of a physical model of a brass instrument.

The structure shown in FIG. 6 is generally used as a physical model tone generator for generating the musical tone of a brass instrument on the basis of the aforementioned physical model. In FIG. 6, a nonlinear portion 100 simulates the lips 3 and the associated members in FIG. 2 and supplies a signal expressing a forward pressure wave generated through the lips 3, to a linear portion 102 through a junction 101. The linear portion 102 simulates the resonance pipe 20, in which signals expressing forward pressure waves and reflected pressure waves as shown in FIG. 2 propagate. The junction 101 simulates the mutual interference between a forward pressure wave and a reflected pressure wave in the lips 3. Then, a forward pressure wave or reflected pressure wave propagating in the linear portion 102 is outputted as a tone signal. The basic structures of the nonlinear portion 102 and the linear portion 101 on the basis of a physical model of a brass instrument and lips will be described successively.

Figure 7:
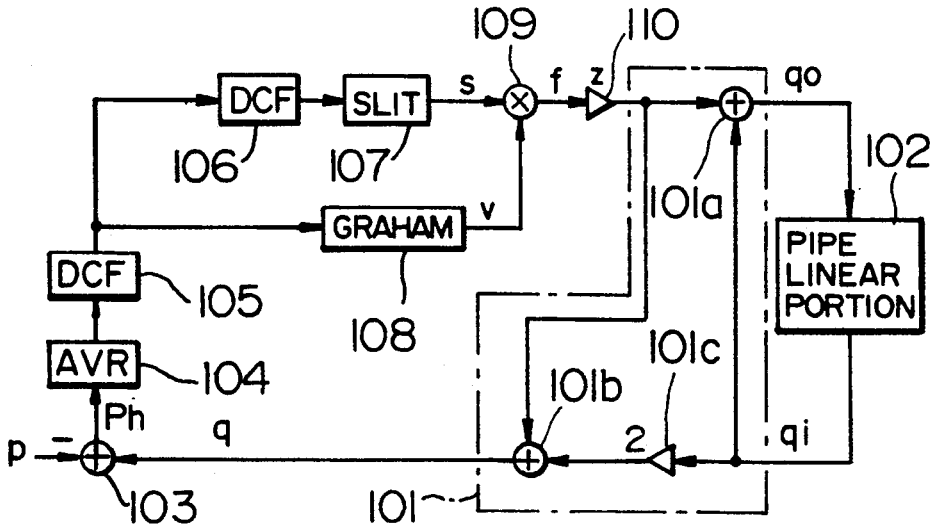
FIGS. 7 to 10 are block diagrams showing examples of the nonlinear portion 100 depicted in FIG. 6.

A.4 Basic Structure of Nonlinear Portion (1) Nonlinear Portion based on the Outer Model The basic structure of the nonlinear portion 100 based on the outer model will be described hereunder with reference to FIG. 7. In FIG. 7, when a pressure signal p expressing breathing pressure and a pressure signal q expressing pressure in the mouthpiece are supplied to an adder 203, the adder 103 calculates the difference (q−p) therebetween and outputs the calculation result as a pressure diffefence signal Ph. The reference numeral 104 designates an automatic voltage regulator (AVR) and 105 a DC filter (DCF). These are provided to prevent the incidental oscillation of the circuit. That is, the AVR 104 suppresses the excessive amplitude change of the pressure difference signal Ph. The DCF 105 removes harmonic components of the pressure difference signal Ph. The pressure difference signal Ph is supplied both to a DCF 106 and to a Graham function table 108 through the AVR 104 and the DCF 105.

The Graham function table 108 applies an arithmetic operation (Graham function) of the equation (A1) to the pressure difference signal Ph and supplies the result as a velocity signal v to a multiplier 109.

In the DCF 106, the DC component of the pressure difference signal Ph is extracted and supplied to a slit function table 107. The slit function table 107 outputs a slit function S corresponding to the pressure difference signal Ph on the basis of the characteristic shown in FIG. 5A. Then, the velocity signal v and the slit S are multiplied by each other in the multiplier 109, so that the multiplication result is supplied, as a flow rate signal f, to a multiplier 110.

In the multiplier 110, the flow rate signal f is multiplied by a constant z. The constant z is a proportional constant of resistance to air flow in the mouthpiece 21 and the resonance pipe 20 in the physical model shown in FIG. 2A, that is, a proportional constant of the air pressure to the air flow rate. Accordingly, a signal expressing air pressure is outputted from the multiplier 110. This signal is added to a reflected wave signal $q_i$ in an adder 101*a* in the junction 101. The reflected wave signal $q_i$ is a signal expressing a reflected wave R1 and R4 which reach the lips 3 in the model shown in FIG. 2A. As a result, a forward wave signal $q_o$ corresponding to the forward pressure waves F1 and F4 in the model shown in FIG. 2A is outputted from the junction 101.

The forward wave signal $q_o$ is supplied to a pipe linear portion 102, and then the reflected wave signal $q_i$ expressing a reflected pressure wave is outputted from the pipe linear portion 102 after the passage of a predetermined time. The reflected wave signal $q_i$ is supplied to the adder 101*a* and multiplied by two through a multiplier 101*c*. The multiplication result is supplied to an adder 101*b*. In the adder 101*b*, the 2-fold reflected wave signal $q_i$ is added to the air pressure signal outputted from the multiplier 110. The addition result is outputted as a pressure signal q expressing pressure in the mouthpiece. The pressure signal p is subtracted from the pressure signal q at this point of time, the subtraction result is outputted as a new pressure difference signal Ph. As described above, the pressure difference signal Ph is continuously outputted through the AVR 104. Thus, the propagation of a pressure wave in the brass instrument is simulated.

(2) Nonlinear Portion Based on the Upper Model

Figure 8:
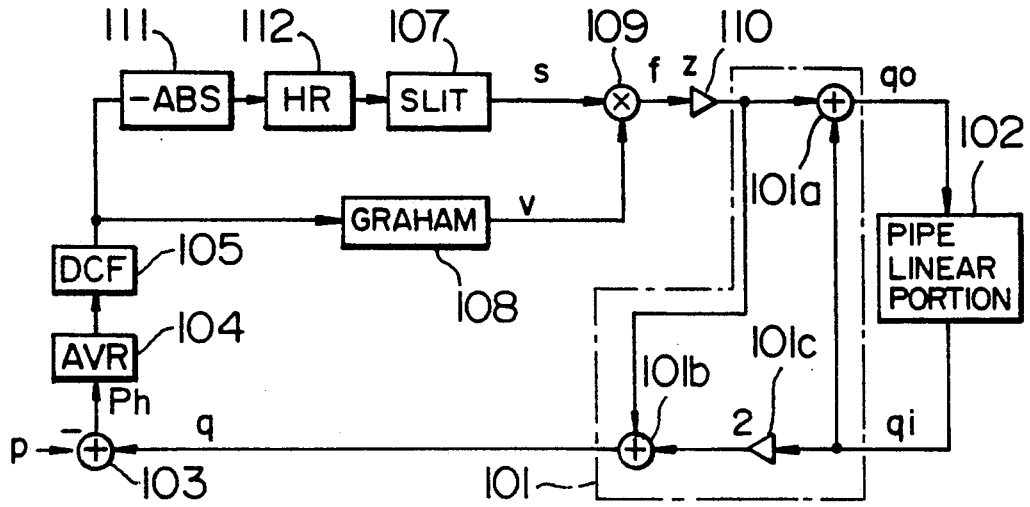

FIG. 8 is a block diagram showing an example of the structure of the nonlinear portion 101 using the upper model. The structure in FIG. 8 is the same as the structure in FIG. 7, except that the DCF 106 107 in FIG. 7 is replaced by a full-wave rectification circuit 111 and a resonance circuit 112.

The full-wave rectification circuit 111 calculates the absolute value of the pressure difference signal Ph supplied through the DCF 105 and outputs the calculation result after the sign thereof is converted into "−" (minus). As a result, the inside of the absolute value signs in the equation (A2) can be calculated. The resonance circuit 112 (which will be described later in detail) is a circuit for simulating the frequency characteristic in the lips 3.

Figure 9:
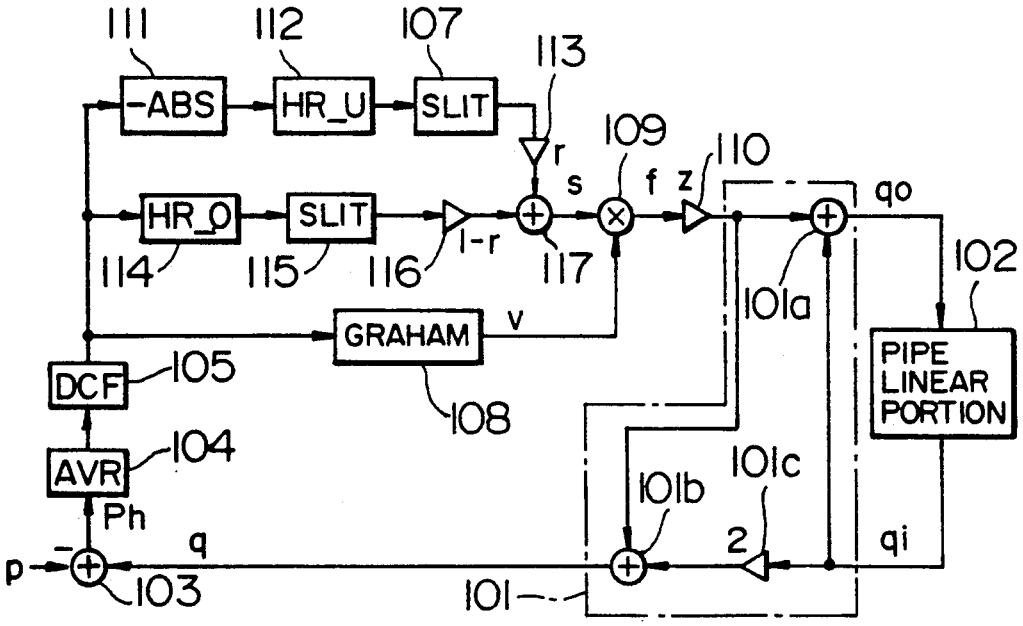

(3) Nonlinear Portion Based on Mixture Model (i) Whole Structure of Mixture Model FIG. 9 is a block diagram showing an example of the structure of the nonlinear portion 100 formed by mixing the outer model and the upper model. In FIG. 9, the full-wave rectification circuit 111, the resonance circuit 112 and the slit function table 107 are provided to achieve the upper model, and a resonance circuit 114 and a slit function table 115 are provided to achieve the outer model.

The slit S outputted from the slit function table 107 is multiplied by a constant r through a multiplier 113 and the multiplication result is supplied to an adder 117. The slit S outputted from the slit function table 115 is multiplied by a constant (1−r) through a multiplier 116, and the multiplication result is supplied to the adder 117. In the adder 117, signals given from the two multipliers are added to each other, and the addition result is supplied to a multiplier 109.

As a result, it is apparent that the slit obtained from the upper model and the slit obtained from the outer model are weighted on the basis of the constant r. Except the aforementioned structure, the structure in FIG. 9 is the same as that in FIG. 7 or 8.

Figure 10:
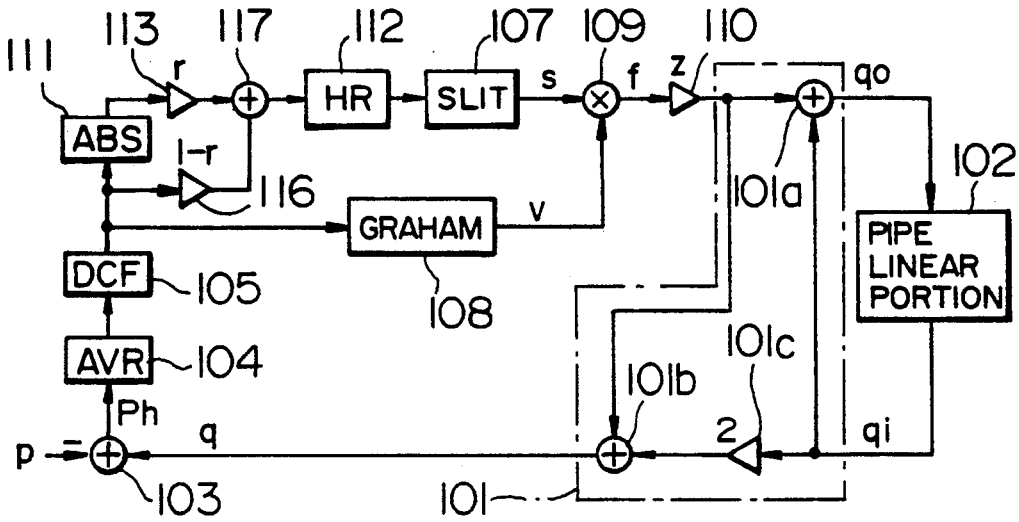

The block diagram of FIG. 9 can be simplified as shown in FIG. 10. In FIG. 10, the resonance circuit 112 and the slit function table 107 are commonly used for the outer and the upper model circuits.

(ii) Structure of Each Resonance Circuits in the Mixture Model

The characteristics of the resonance circuits 112 and 114 will be described hereunder.

The resonance circuit 112 which is a circuit for simulating the resonance condition of the lips 3 on the basis of the upper model has resonance characteristic which is similar to a band-pass filter. That is, a pitch frequency Fp is set in the vicinity of the resonance frequency Fu of the resonance circuit 112, so that the amplitude increasing ratio Qu is very large. Accordingly, it can be considered that signals out of the pass band are removed almost perfectly.

Assuming now that the resonance circuit 112 is actually used in an electronic musical instrument, the amplitude increasing ratio Qu may be changed suitably for tone generation. Accordingly, the resonance circuit 112 is preferably so constructed that the change of the gain in the vicinity of the pitch frequency Fp becomes small even in the case where the amplitude increasing ratio Qu is changed. It is sufficient to afford the resonance frequency Fp and the amplitude increasing ratio Qu as variable parameters for this circuit.

The resonance circuit 114 is a circuit for simulating the outer reed portion 3*a* (see FIG. 12). As described above, the outer reed portion 3*a* operates relatively slowly compared with the upper reed portion 3*b*. Accordingly, it is necessary that the time constant of the resonance circuit 114 is set to a very small value compared with that of the resonance circuit 112. According to the analysis by the present inventor, the time constant of the resonance circuit 114 is preferably set to about 30 msec (in this case, the resonance frequency becomes about 30 Hz).

Figure 11:
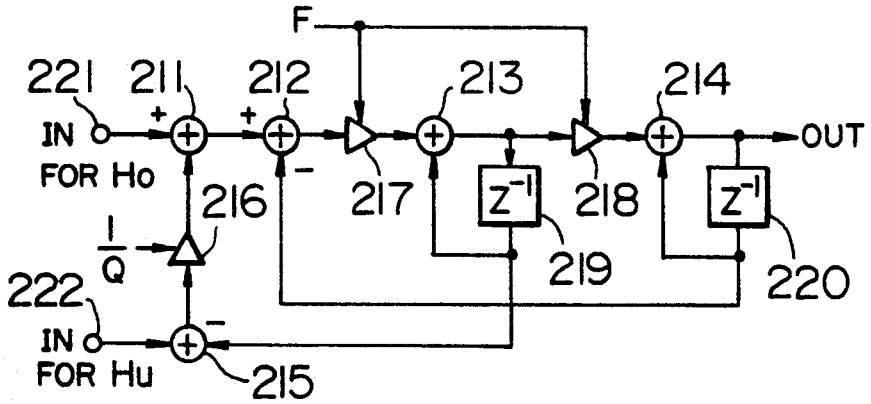
FIG. 11 is a block diagram showing an example of the resonance circuit 112 or 114.

Each of the resonance circuits 112 and 114 may be constituted by a DC filter of second order as shown in FIG. 11. In FIG. 11, the reference numerals 211 to 215 designate adders and 216 to 218 multipliers. A multiplication coefficient "1/Q" (in which Q is the amplitude increasing ratio) is supplied to the multiplier 216, and resonance frequency F is supplied to the multipliers 217 and 218 as a multiplication coefficient. The reference numerals 219 and 220 designate delay circuits which are combined with the adders 213 and 214 to form integration circuits.

The filter circuit shown in FIG. 11 can be used as each of the resonance circuits 112 and 114 through changing the signal input terminals thereof suitably. That is, the resonance circuit shown serves as the resonance circuit 114 when a signal is given from the input terminal 221 and also serves as the resonance circuit 112 when a signal is given from the input terminal 222. Hereinafter, the transmission function of the resonance circuit 112 is represented by $Hu(\omega)$ and the transmission function of the resonance circuit 114 is represented by $Ho(\omega)$.

(iii) Operation of the Mixture Model

The operation of the mixture model shown in FIG. 9 will be described hereunder with reference to FIG. 13.

Figure 13:
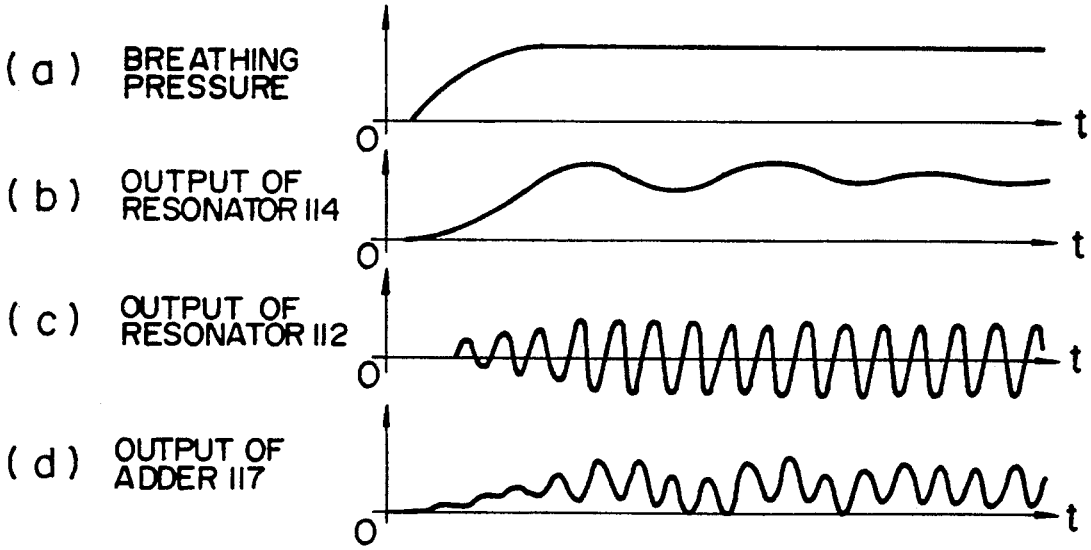
FIG. 13, which includes 13(*a*)–13(*d*), is a graph of waveforms at various points depicted in FIG. 9.

When the breathing pressure signal p increases as shown in the waveform (a) in FIG. 13, the output signal from the resonance circuit 114 slowly increases and converges to a predetermined value with some ringing as shown in the waveform (b) in FIG. 13. This phenomenon is equivalent to the phenomenon that the slit S in FIG. 12 is slowly widened by slowly opening the outer reed portion 3*a* when the pressure in the buccal cavity becomes large.

The resonance circuit 112 having a high resonance frequency exhibits an oscillating phenomenon by the interaction with the pipe linear portion 102. Accordingly, the output signal waveform from the resonance circuit 112 becomes a sinusoidal wave of predetermined amplitude as shown in the waveform (c) in FIG. 13. The output signals from the two resonance circuits are weighted through the multipliers 113 and 116 and then outputted through the adder 117. The output signal from the adder 117 is a signal equivalent to the slit S of the lips 3 and has a signal waveform as shown in the waveform (d) in FIG. 13.

As described above, according to the mixture model shown in FIG. 9, the output signal waveform from the adder 117 is disturbed shortly after the breathing pressure signal p is given, due to the use of the resonance circuits 112 and 114 in combination. In an acoustic brass instrument, it is known that an unstable behavior is exhibited at the time of breathing-out (at the time of attack). Accordingly, it is apparent that the unstable behavior peculiar to the brass instrument at the time of attack can be simulated by the mixture model shown in FIG. 9.

(4) Local Feedback Removal Model (i) Problem Related to Local Feedback

In the respective models (1) to (3), a multiplication result obtained by multiplying the flow rate signal f by resistance z against air flow is instantaneously fed back to the adder 103 through the adder 101*b*. Accordingly, there arises a risk that a limit cycle (abnormal oscillation at high frequency) occurs in the feedback loop (local feedback loop). In order to avoid the risk, it is necessary to insert the DCF 105, the AVR 104 or the like in the loop circuit.

There are, however, some cases where it is difficult to sufficiently suppress the limit cycle by the DCF 105 and the AVR 104. The use of DCF 105 and the AVR 104 may, on the other hand, narrow the tone color. Accordingly, if the local feedback loop can be removed from the nonlinear portion, the DCF 105 and the AVR 104 can be removed while the limit cycle is suppressed.

(ii) Means for Removing the Local Feedback Loop

Removal of local feedback loop can be made by analyzing the transmission function of a system having a local feedback loop and employing a system having a transmission function equivalent to the obtained transmission function and having no local feedback loop.

Figure 15:
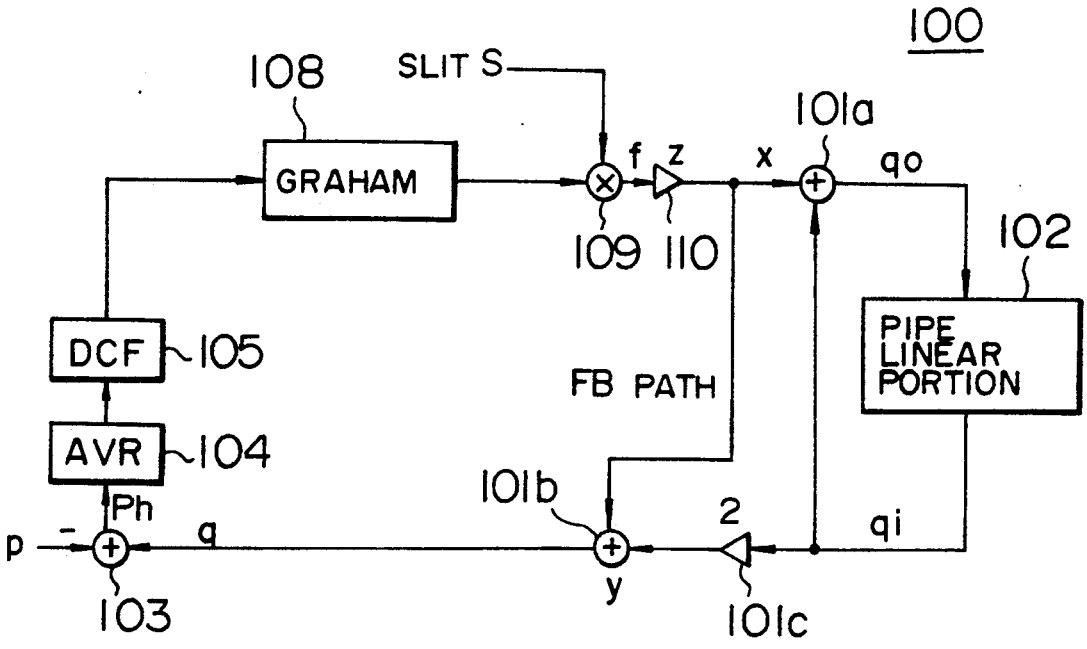
FIGS. 15 and 16 are block diagrams showing examples of nonlinear portion 100.

For explaining this approach, a model simplifying the systems of FIGS. 8 to 10 which have each local feedback loop, is shown in FIG. 15. In this model, it is assumed that the slit signal S supplied to the multiplier 109 is constant for the simplification of explanation.

Figure 16:
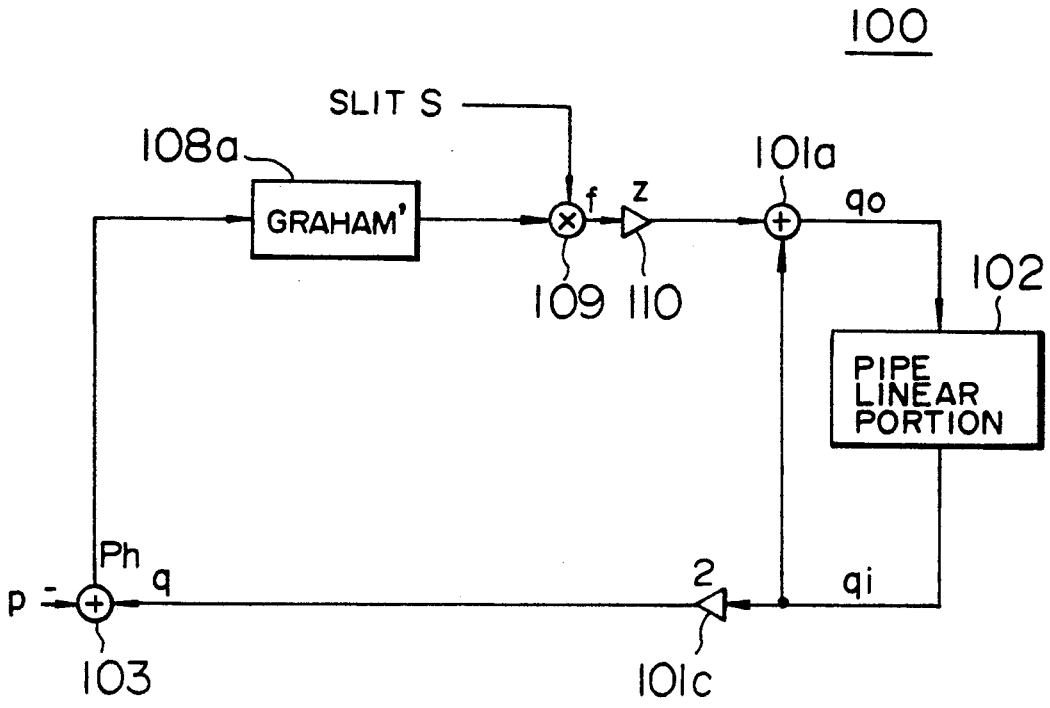
Figure 17:
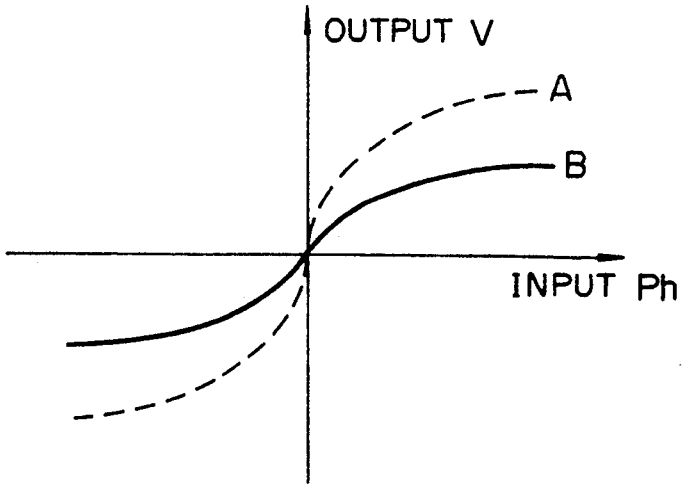
FIGS. 17 to 19 are graphs showing examples of outline of Graham function.

By analyzing the response of the output signal y of the multiplier 101*c* to the output signal x of the multiplier 110 in the circuit of FIG. 15 where the slit signal S is constant, a system as shown in FIG. 16, which is equivalent to the system of FIG. 15 and has no local feedback loop can be obtained. The characteristic curve A of the Graham function table 108 in FIG. 15 and the characteristic of the Graham function table 108*a* in FIG. 16 are shown in FIG. 17 as curves A and B, respectively.

The circuit in FIG. 16 is equivalent to the circuit in FIG. 15 but the equivalence only holds for a predetermined slit signal S. Accordingly, in the case where the slit signal S takes various values, the Graham function in the table 108*a* need be corrected suitably through obtaining the response characteristic between the signals x and y.

Figure 18:
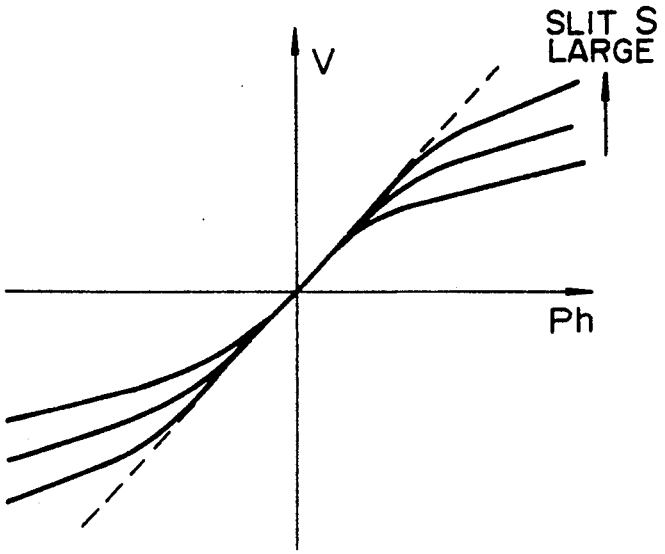

In the case where there is any local feedback loop, the change of the Graham function with the change of the slit signal S is shown in FIG. 18. It is apparent from FIG. 18 that the Graham function has saturation characteristic that the value thereof converges on predetermined gain characteristic as the slit functions becomes large.

Figure 19:
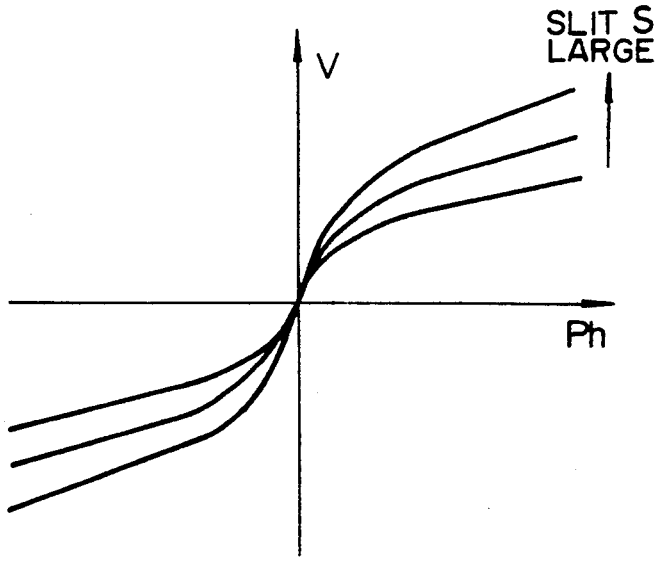

In the case where there is no feedback loop, the change of the Graham function with the change of the slit signal S is shown in FIG. 19. It is apparent from FIG. 19 that the Graham function has monotonously proportional characteristic for the slit signal S. The musical tone of a brass instrument, especially trumpet, is distinguished by a sharp tone containing a lot of harmonic components. The provision of the change of the Graham function as shown in FIG. 19 is indispensable to simulation of this characteristic.

When the local feedback loop is removed by the aforementioned approach, there however may arises the necessity that a large gain is given to the open-loop system (i.e. loop system including the pipe linear portion 102). As a result, there may arises abnormal oscillation in the open-loop system.

According to the analysis by the present inventor, it is proved that the abnormal oscillation is caused by the fact (see FIG. 19) that the gradient of the Graham function is very large when the pressure difference signal Ph is near "0". Accordingly, more preferably, the gradient of the Graham function for the pressure difference signal Ph near "0" is suppressed by some expedient in the case where the local feedback loop is removed.

(iii) Means for Suppressing the Gradient of the Graham Function

Figure 20:
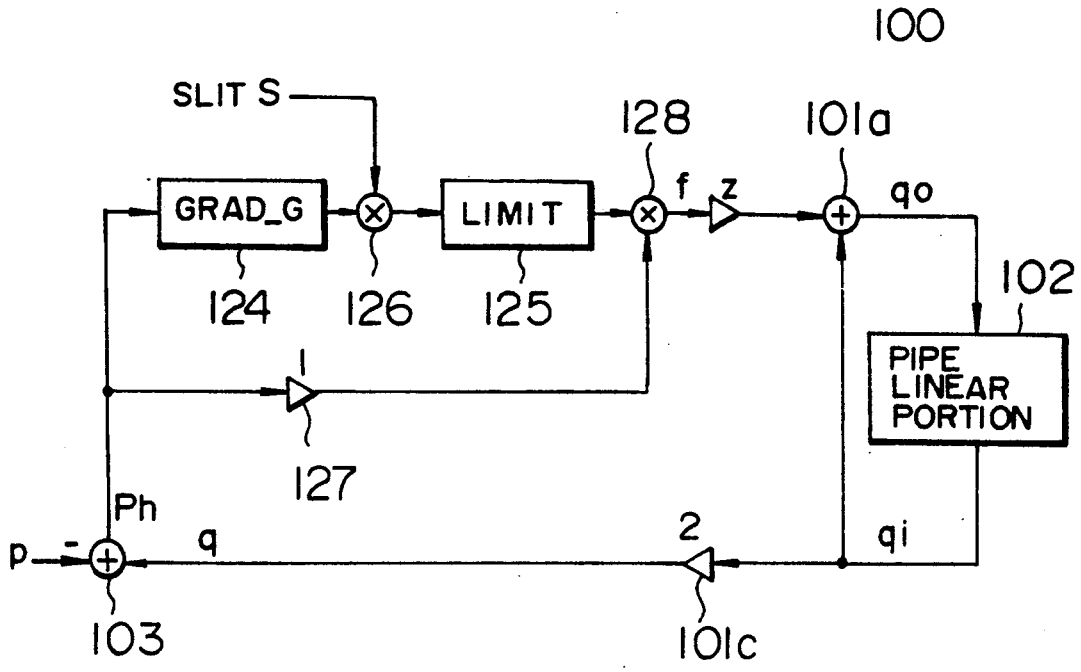
FIG. 20 is a block diagram showing an example of the nonlinear portion 100.

As an expedient for suppressing the gradient of the Graham function, use of the circuit structure as shown in FIG. 20 can be employed.

In FIG. 20, a function obtained by dividing the Graham function in the table 108*a* (see FIG. 16) by the pressure difference signal Ph is stored in the function table 124. The multiplier 126 multiplies the output signal from the function table 124 by the slit function S.

Figure 21A:
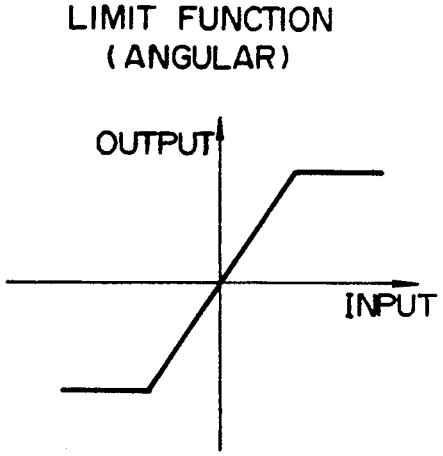
FIGS. 21A and 21B are graphs showing characteristic of the limit circuit 125.

The limit circuit 125 is a circuit for limiting the output signal from the multiplier 126 to a predetermined value when the output signal from the multiplier 126 exceeds a predetermined value. The limit circuit 125 has input-/output characteristic as shown in FIG. 21A. The multiplier 128 multiplies the output signal from the limit circuit 125 by the pressure difference signal Ph supplied through the multiplier 127.

In the aforementioned structure, the circuit shown in FIG. 20 is equivalent to the circuit shown in FIG. 16 as long as the limit circuit 125 does not carry out the limiting operation. This is because the output signal from the function table 124 in FIG. 20 is equal to a value obtained by dividing the output signal from the Graham function table 108*a* in FIG. 16 by the pressure difference signal Ph and this output signal of the function table 124 is multiplied by the pressure difference signal Ph through the multiplier 128.

Figure 22:
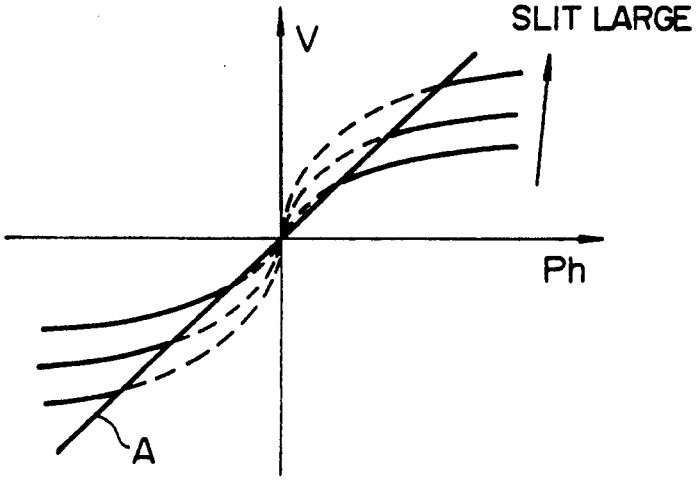
FIG. 22 is a graph showing outlines of modified Graham function.

When the limit circuit 125 carries out the limiting operation, the input/output relation is equal to that in the case where the Graham function is limited by a line A as shown in FIG. 22. As a result, the change of the Graham function approximating the change shown in FIG. 19 can be provided while the gradient of the Graham function is limited. The change of the Graham function in the case where a limit function shown in FIG. 21A is used is shown in FIG. 22.

Figure 21B:
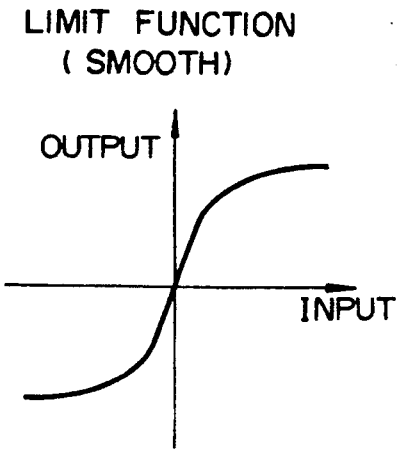

The input/output characteristic of the limit circuit 125 may be smoothed as shown in FIG. 21B. In this case, the gradient of the Graham function is limited asymptotically, so that it is considered that a more natural musical tone can be generated.

A.5 Structure of Pipe Linear Portion

The structures of various models of the pipe linear portion 102 will be described hereunder.

(1) Pipe Linear Portion Based on K-L Lattice Model

Figure 23:
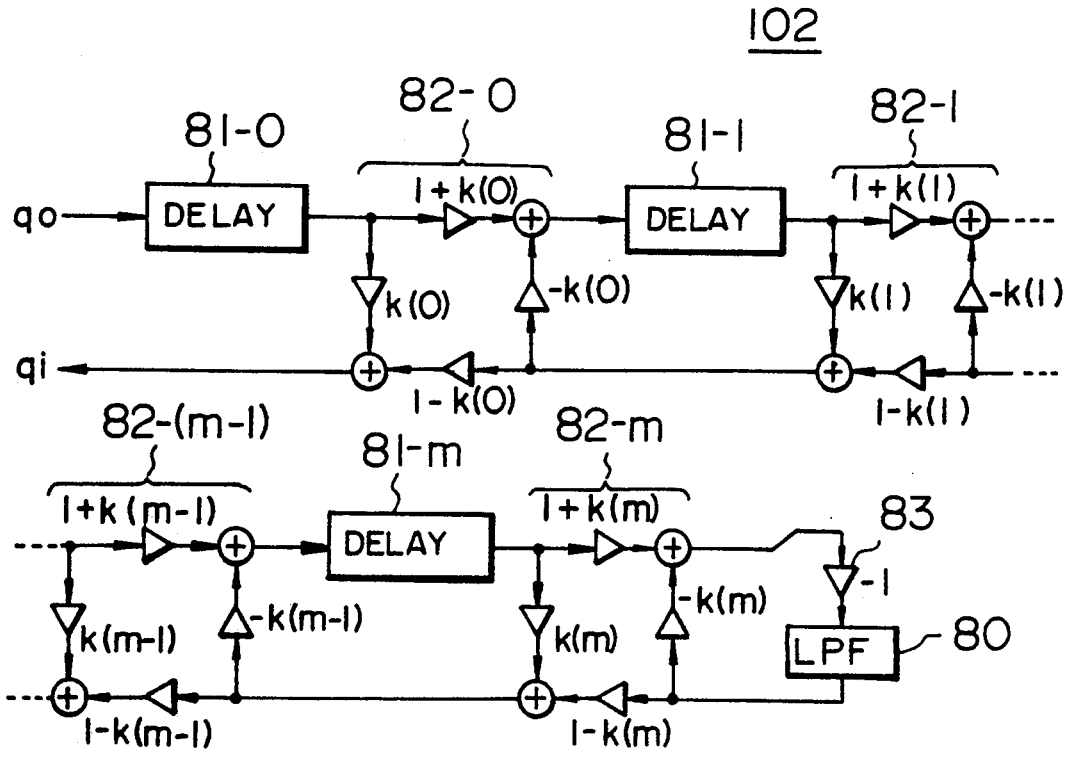
FIG. 23 is a block diagram of the linear pipe portion 102.

A K-L lattice model as shown in FIG. 23 is known as an example of model for providing the pipe linear portion.

The resonance pipe 20 (see FIG. 2) of the brass instrument is generally shaped like a cone. In the K-L lattice model, the propagation of a pressure wave in the resonance pipe 20 is simulated by approximating the conical shape by a multistage cylindrical shape having a stage number m (which is a natural number not smaller than "2").

In FIG. 23, the reference numerals 81-0 to 81-*m* designate delay circuits for simulating propagation delays of vibrations at respective stages in the multistage cylinder-shaped pipe. The reference numeral 83 designates an inversion circuit for simulating the reflection of a pressure wave at the terminal portion of the pipe. Loss upon the reflection is simulated by a low-pass filter 80.

The reference numerals 82-0 to 80-*m* designate junctions for simulating the reflection of pressure waves at respective points or diameter steps of the pipe. The aforementioned constituent members are generally connected in a loop to simulate the body portion 20 in the model shown in FIG. 20.

Because the pipe linear portion based on the K-L lattice model is similar to a known pipe linear portion used for simulating a woodwind instrument, various kinds of circuits have been disclosed by the assignee of this application in European Patent Application Publication No. 0393703 and Japanese Patent Application Laid-Open Nos. Hei-3-121498 and Hei-3-119393.

(2) Pipe Linear Portion Based on Cylindrical Approximation Model

The conical resonance pipe 20 can be also approximated by connecting two cylindrical pipes in parallel.

Figure 24:
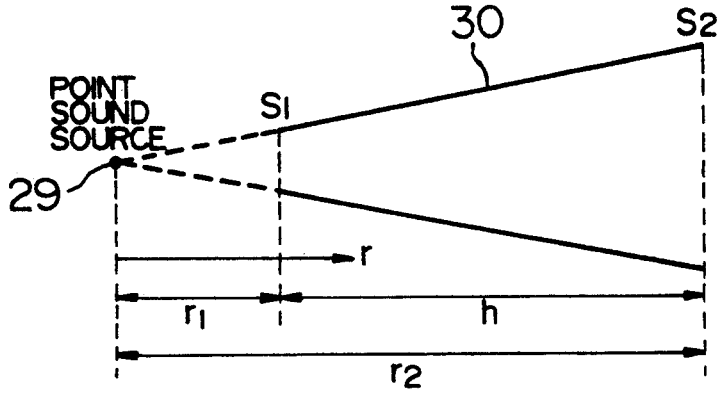
FIG. 24 is a diagram showing the positional relation between a conical pipe 30 and a point sound source 29.

As shown in FIG. 24, where there are a conical horn 30 serving as a resonance pipe and a point sound source 29, the input impedance $Z_1$ of the conical horn 30 is given by the following equation (A3):

$$Z_1 = j\rho c \frac{kr_1 \sin kh}{\sin kh + r_1 \cos kh} = \frac{1}{\frac{1}{Z_2} + \frac{1}{Z_3}} \quad \text{(A3)}$$

where k represents the frequency of the point sound source, $r_1$ represents the distance between the point sound source 29 and the conical horn 30, h represents the length of the conical horn 30, $r_2$ represents the sum of $r_1$ and h, $\rho$ represents the density of air as a medium for propagating an acoustic wave, c represents the sound velocity, and $Z_2$ and $Z_3$ represent characteristic impedances of approximating cylinders.

Figure 25:
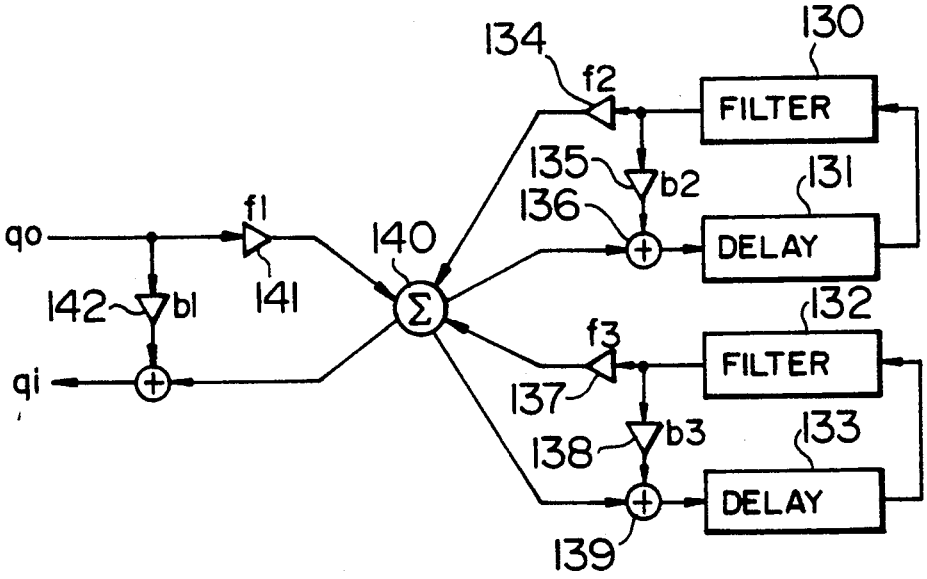
FIG. 25 is a block diagram of a physical model of a conical pipe.

It is apparent from equation (A3) that the conical horn 30 is equivalent to two cylindrical pipes connected in parallel. A model of a pipe linear portion formed by using this model is shown in FIG. 25. In FIG. 25, one of the two cylindrical pipes is simulated by a filter 130, a delay circuit 131, etc. That is, the propagation delay of a pressure wave in the cylindrical pipe is simulated by the delay circuit 131, and loss in the inside of the cylindrical pipe is simulated by the filter 130. As shown in FIG. 25, the filter 130 and the delay circuit 131 are connected to an adder 140 through multipliers 134 and 135 and an adder 136.

The other cylindrical pipe is simulated by a filter 132, a delay circuit 133, etc., in a similar manner as described above. Then, the parallel connection of the two cylindrical pipes is simulated by the adder 140.

In view of the energy conservation law, multiplication coefficients b1, b2 and b3 in multipliers 142, 135 and 138 are considered to take a value "−1", and multiplication coefficients f1, f2 and f3 in multipliers 141, 134 and 137 are considered to take a value "0.5", for one tone color. Because there are, however, a lot of combinations of coefficient values for operating the model normally as a system, the tone color can be widened by setting these multiplication coefficients to various values.

(3) Planning of Pipe Linear Portion

A procedure adapted for actually planning a pipe linear portion on the basis of the aforementioned model will be described hereunder.

(i) Basic Planning Method

In an acoustic brass instrument, a mode is selected correspondingly to the degree of lip tension while adjusting the pipe length in order to provide an arbitrary pitch. In an acoustic brass instrument, a variable length portion is formed of a straight pipe. In the physical model, the adjustment of the pipe length can be simulated by using a shift register as a variable delay circuit.

Figure 41:
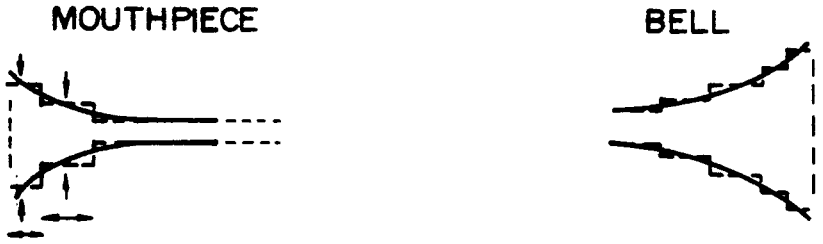
FIG. 41 is a diagram showing a mouthpiece portion and a bell portion respectively approximated by cylindrical pipes.

Portions before and after the variable length portion, i.e. a mouthpiece portion and a bell portion, have various shapes corresponding to various kinds of musical instruments. To simulate these portions, following procedures may be taken. First, the shapes of the mouthpiece portion and the bell portion may be displayed on a display panel as shown in FIG. 41. Then, these portions can be simulated by multistage cylindrical pipes approximating the displayed shapes.

Figure 31:
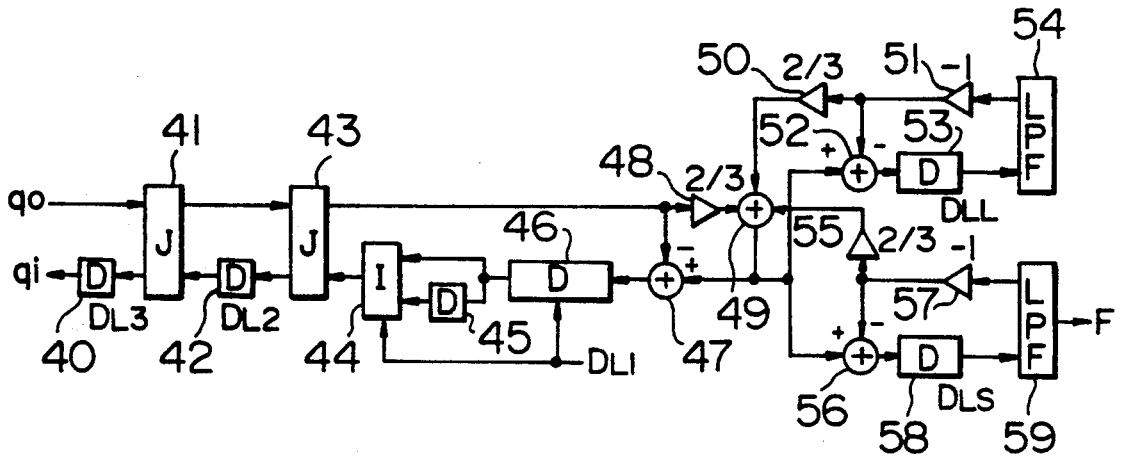
FIGS. 31 and 32 are block diagrams showing examples of the linear pipe portion 102.

In FIG. 31 shows a model of a pipe linear portion formed by combining a K-L lattice model and a cylindrical approximation model. In FIG. 31, delay times in delay circuits 40 and 42 are selected in accordance with the length of the corresponding cylinders. An integration circuit 44 and delay circuits 45 and 46 simulate the variable length portion and provide a delay time $D_{L1}$ corresponding to the pipe length. Further, delay times at cylinders approximating the mouthpiece portion are simulated by delay circuits 40 and 42. Further, the bell portion is approximated by a conical shape, and delay times $D_{LL}$ and $D_{LS}$ at delay circuits 53 and 58 are set in correspondence to the shape of flare.

When the shape of the bell portion is altered, not only lattice coefficients and delay times in the K-L lattice model are influenced, but also the radiation characteristic are influenced. That is, because lower frequency can be radiated as the size of the bell increases, it is necessary to reduce the cutoff frequency in the low-pass filters 54 and 59.

It is a matter of course that a physical model of a brass instrument may be formed by using the K-L lattice model without use of the cylindrical approximation model.

(ii) Auto Tuning Using PLL

According to the aforementioned planning method, the resonance frequency Fu can be determined on the basis of the key code, but the pipe length corresponding to the delay time $D_{L1}$ cannot be determined unless the pipe is actually approximated by waveguides. In adjusting the tone color, various parameters related to the pipe linear portion and the nonlinear portion need be changed. Here, it is very time-consuming to tune the pitch each time when parameters are changed.

Therefore, the present inventor has developed procedures of tuning the pipe length, that is, tuning the delay time $D_{L1}$ to adjust the oscillation frequency to a desired pitch by actually oscillating a system including the pipe. The procedures will be described hereunder.

The resonance frequency Fu is given, for a desired pitch frequency Fp, by the following equation:

$$Fu = Ku \times Ep \tag{A4}$$

where Ku represents a constant which is usually slightly larger than "1". Although there are a lot of parameters which cannot be determined without lip controller information, default values may be given to such parameters in advance. With respect to parameters varying at random, random numbers which have a desired width of variation are given. Then, the total delay time DLT in the model shown in FIG. 31 is calculated and then the delay time DL1 is calculated on the basis of the total delay time as follows:

$$D_{LT} = D_{L1} + D_{L2} + D_{L3} + D_{LS} + D_{LL}$$

$$D_{L1} = D_{LT} - (D_{L2} + D_{L3} + D_{LS} + D_{LL}) \tag{A5}$$

Assuming now that tuning is started from the minimum pitch (mode No. (vibration mode)=2, full-open piston), the approximated value ($D_{LT}$, max) of the total delay time DLT at the minimum pitch is calculated as follows. Because the minimum pitch (Fp, mim) is in the second mode, the approximated value is given by equation (A6).

$$(D_{LT}, \max) = 2/(Fp, \min \times T) \tag{A6}$$

The delay time ($D_{L1}$, max) at the minimum pitch is calculated by substituting this value into equation (A5). The optimum value of the delay time $D_{L1}$ at a target pitch frequency is calculated by applying PLL to the calculated delay time ($D_{LT}$, max) with use of the pitch frequency Fp as a target frequency.

Assuming now that the next target pitch is a half tone higher than the minimum pitch, the pitch shows a value 1.06 times as much. That is, the total pipe length $D_{LT}$ is multiplied by about 1/1.06. After the total delay time $D_{LT}$ at the minimum pitch is calculated according to equation (A5) on the basis of the delay time $D_{L1}$ at the previously calculated minimum pitch and multiplied by 1/1.06, the delay time $D_{L1}$ is calculated again according to equation (A5) and then PLL is applied again to the calculated delay time $D_{L1}$. Accurate initial values for respective pitches can be obtained by successively calculating delay times $D_{L1}$ corresponding to higher pitches in the similar manner as described above, so that optimum delay times $D_{L1}$ can be obtained by applying PLL thereto.

When tuning is thus advanced while successively ascending the pitch, the pitch reaches the maximum pitch in this mode. That is, there arises necessity of ascending the pitch by switching the mode, instead of switching the piston. When the mode is switched, the pipe length is returned to the original length. The delay time $D_{L1}$ in this case is considered to be substantially equal to the previously calculated delay time $D_{L1}$ at the minimum pitch. Accordingly, optimum delay times $D_{L1}$ can be also obtained by setting previously obtained the delay time $D_{L1}$ at the minimum pitch as an initial value of $D_{L1}$ after the switching of the mode and then applying PLL to the initial value.

A.6 Improvement in Envelope Generation

In the so-called physical model tone generator as in this embodiment, generation of the envelope of the musical tone greatly depends on various parameters given from the outside. That is, various parameters in the outer reed portion contribute to generation of the envelope. The greater part of the envelope characteristic is determined by an envelope signal given by control software, or a breathing pressure p given by the player. According to the observation by the present inventor, it has been found that the breathing pressure p has an insensible zone and hysteresis characteristic in the playing of an acoustic brass instrument. That is, it has been found that no tone is generated unless the breathing pressure p reaches a predetermined value (threshold) $p_{th}$ in the initial stage of tone generation and the generated tone does not disappear unless the breathing pressure p decreases to a predetermined value (threshold) $p_{tl}$ in termination of tone generation. Here, the predetermined value $p_{th}$ is always larger than the predetermined value $p_{tl}$.

Figure 42A:
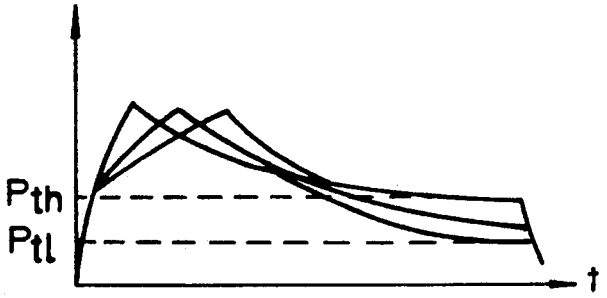
FIGS. 42A and 42B are graphs showing hysteresis characteristics of a brass instrument.
Figure 42B:
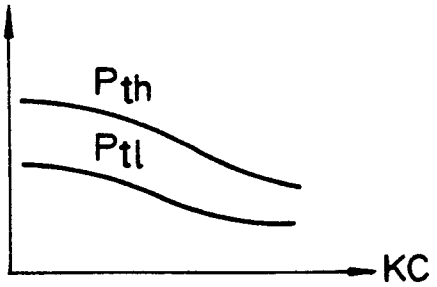

These predetermined values $p_{th}$ and $p_{tl}$ vary according to various parameters and tone ranges. Musical tones of an acoustic brass instrument can be reproduced more faithfully by controlling musical tones on the basis of approximate values of $p_{th}$ and $p_{tl}$ obtained in advance corresponding to the key code KC as shown in FIG. 42B. That is, the physical model is constructed so that no musical tone is generated before the envelope signal exceeds the predetermined value pth and, tone generation is stopped when the envelope signal becomes smaller than the predetermined value ptl, as shown in FIG. 42A.

B. Structure of the Embodiment

The structure of this embodiment will be described with reference to the drawings.

(1) Overall Structure

Figure 1:
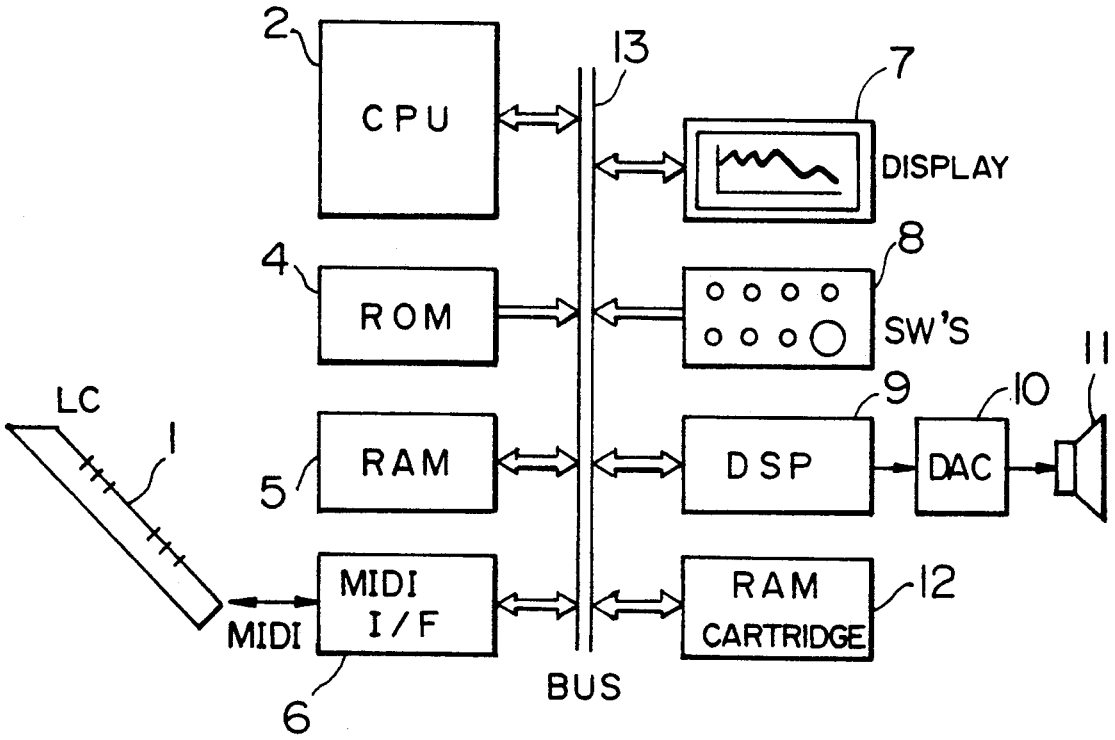
FIG. 1 is a block diagram showing the structure of an embodiment of the present invention.

The overall structure of this embodiment is shown in FIG. 1.

In FIG. 1, a lip controller 1 imitating a brass instrument converts performance information given by a player into MIDI signals. An MIDI interface 6 receives the MIDI signals from the lip controller 1 and supplies the MIDI signals to respective portions through a bus 13. A central processing unit (CPU) 2 controls other constituent members on the basis of a processing program stored in a read-only memory (ROM) 4 in advance. Various kinds of data, tables, and the like, used in processings are further stored in the ROM 4 in advance.

A switching circuit 8 has various switches, manipulators, and the like, for controlling tone color, etc. A display 7 provided to display various kinds of information on the basis of control by the CPU 2. A digital signal processor (DSP) 9 generates a tone signal on the basis of the performance information supplied from the CPU 2 through the bus 13. The generated tone signal is converted into an analog signal through a digital-/analog converter (DAC), so that a musical tone is generated through a sound system 11.

A random access memory (RAM) 5 is provided as a work memory necessary for the processings of the CPU 2. It may be more preferable that the RAM is constituted by a battery backup type memory to prevent the missing of data. A RAM cartridge 12 constituted by a nonvolatile RAM is provided so as to be detachable from the bus 13 so that the CPU 2 can read and write data therefrom and therein freely and as in the RAM 5. The RAM cartridge 12 is adapted for storing tone color data.

(2) Structure of Lip Controller 1

The structure of the lip controller 1 will be described hereunder with reference to FIG. 26.

Figure 26:
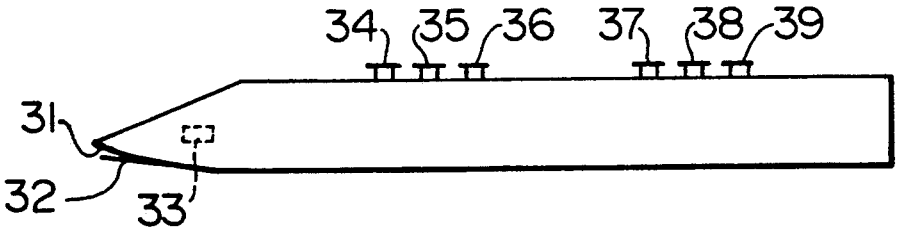
FIG. 26 is a side view of the lip controller 1.

In FIG. 26, the lip controller 1 is shaped like a long pipe having a blowing port 31 at one end. An embouchure sensor 32 is provided in the blowing port 31. The embouchure sensor 32 detects the pressing force of the lips 3 (not shown) and generates the detection result as an embouchure signal emb.

Reference numeral 33 designates a pressure sensor for detecting the breathing pressure given by a player through the blowing port 31. A first piston 34, a second piston 35 and a third piston 36 carry out the same operations as those of first, second and third pistons of an acoustic brass instrument, respectively. That is, when the first piston 34 is pressed down, the pitch of the resulting musical tone is lowered by one tone. When the second piston 35 is pressed down, the pitch of the resulting musical tone is lowered by a half tone. When the third piston 36 is pressed down, the pitch is lowered by one and a half tones.

Reference numerals 37, 38 and 39 designate pistons provided for lowering the pitch more greatly. When the piston 37 is pressed down, the pitch is lowered by a half octave. When the piston 38 is pressed down, the pitch is lowered by one octave. When the piston 39 is pressed down, the pitch is lowered by two octaves. Octave displacements which can be established by using the pistons 37 to 39 in combination are shown in Table 1.

TABLE 1

| (37, 38, 39) ON = 1, OFF = 0 | 000 | 100 | 010 | 110 | 001 | 101 | 011 | 111 |
|---|---|---|---|---|---|---|---|---|
| Octave Displacement | 0 | 0.5 | 1 | 1.5 | 2 | 2.5 | 3 | 3.5 |
| Mode Number | 2 | 3 | 4 | 6 | 8 | 12 | 16 | 24 |

In Table 1, a figure of three digits described in the uppermost line expresses the on/off state of the pistons 37 to 39, in which "0" shows the off state, and "1" shows the on state. A mode number in each condition is shown in the lowermost line. In an acoustic brass instrument, the mode number can be designated by the degree of lip tension. However, it is somewhat difficult to measure the degree of lip tension, and it is considered that the reality of the resulting musical tone is not degraded even when the mode number is designated by the pistons 37 to 39. Accordingly, designation of the mode number is done in the aforementioned manner in this embodiment.

(3) Software Structure of ROM 4

Figure 29:
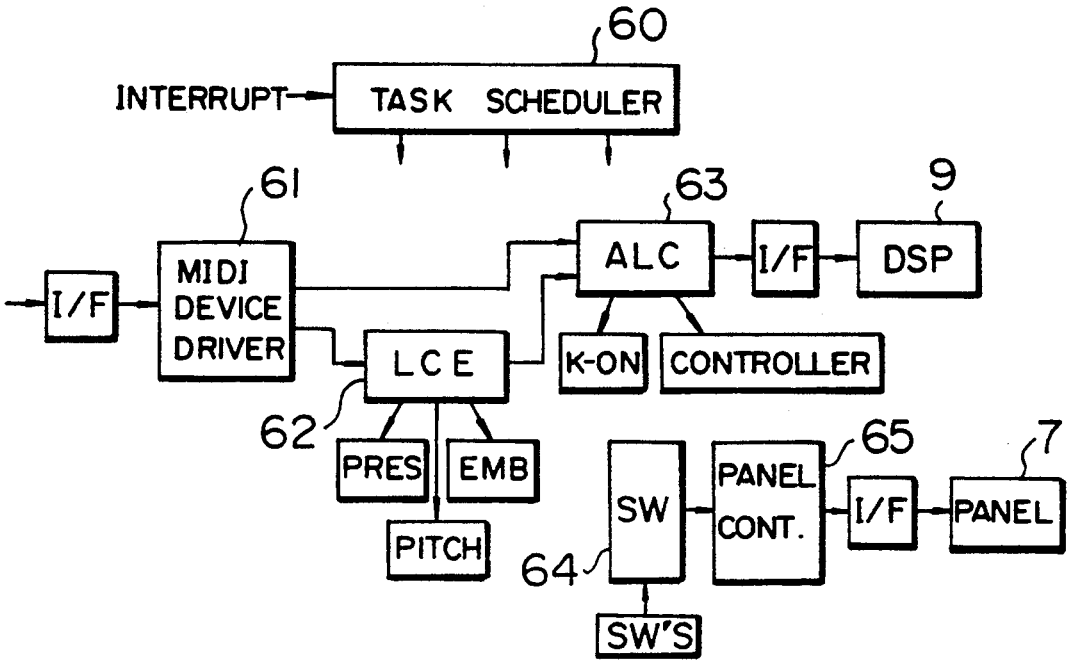
FIG. 29 is a block diagram of a control program set in the ROM 4.
Figure 30:
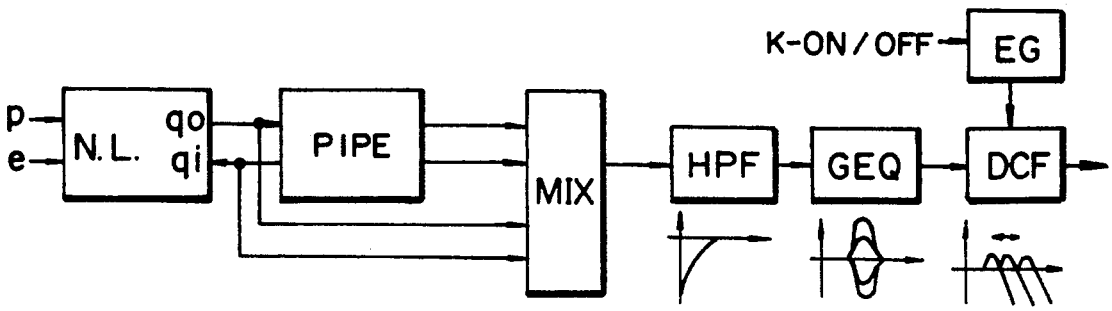
FIG. 30 is a block diagram showing the whole structure of the digital signal processor (DSP) 9.

The overall structure of the control program stored in the ROM 4 will be described with reference to FIG. 29. In FIG. 29, a task scheduler 60 is driven through timer interruption at intervals of a predetermined period and carries out other programs by way of time division.

An MIDI device driver 61 converts the MIDI signal received through the MIDI interface 6 (see FIG. 1) into performance information used in the electronic musical instrument and supplies the performance information to other programs.

An LC emulator program (LCE) 62 is a program for converting MIDI signals given by a keyboard into signals equivalent to the MIDI signals given by the lip controller 1 when the keyboard, instead of the lip controller 1, is used as a performance information input device.

An algorithm control program (ALC) 63 generates a key-on signal KON on the basis of the performance information given from the MIDI device driver 61 or the LCE 62, calculates various parameters for tone control on the basis of the performance information and supplies the parameters to the DSP 9.

The respective programs will be described later in detail in connection with the operation thereof.

(4) Structure of DSP 9

The structure of the DSP 9 will be described hereunder. The DSP 9 comprises a high-speed CPU, ROM for storing a control program used in the CPU, and a RAM used as a work memory (not shown). The control program stored in the ROM contains programs for simulating the nonlinear portion 100, the junction 101 and the pipe linear portion 102 in the physical model tone generator as shown in FIG. 6.

Figure 27:
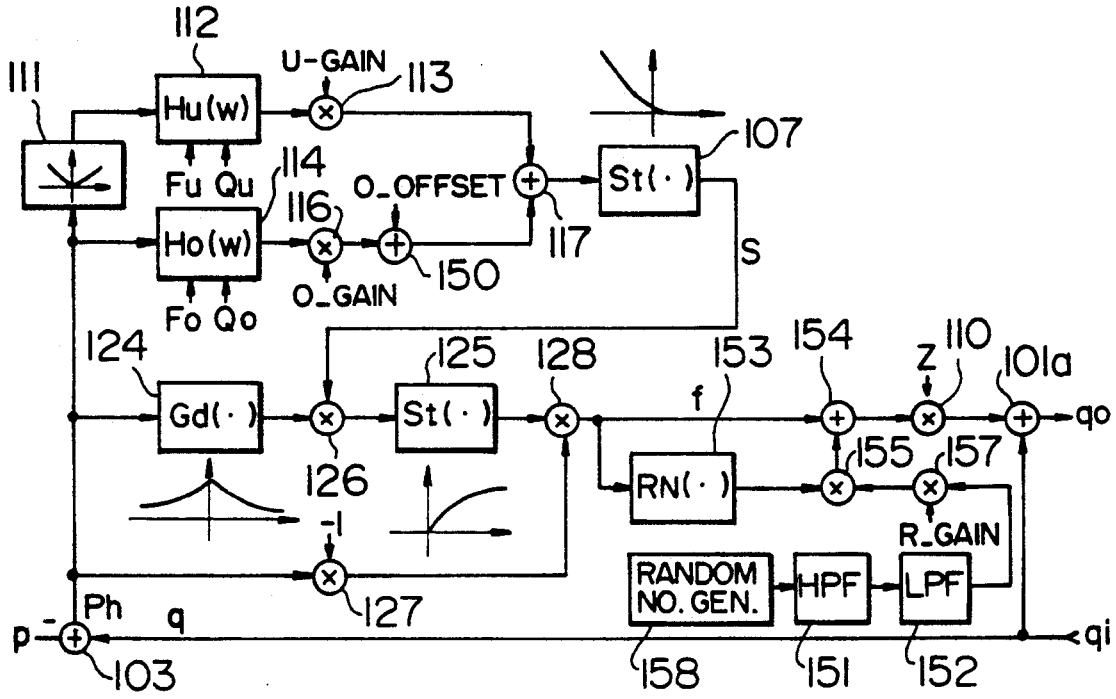
FIG. 27 is a block diagram showing an example of the nonlinear portion 100.
Figure 28A:
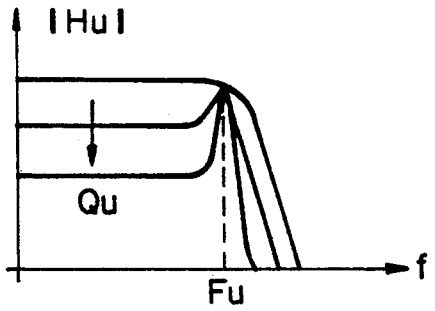
FIGS. 28A and 28B are characteristic graphs of the resonance circuit 112 or 114.
Figure 28B:
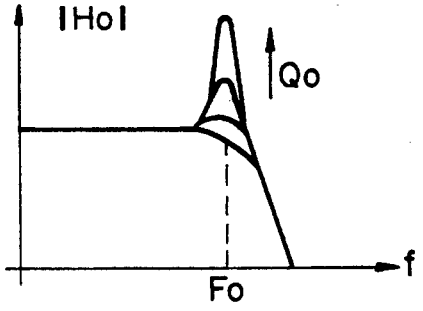

The structure of the algorithm of the program for providing the pipe linear portion 102 is equivalent to the model of the pipe linear portion shown in FIG. 31. The algorithm of the program for providing the nonlinear portion 100 and the junction 101 is constructed as shown in the block diagram of FIG. 27. The algorithm shown in FIG. 27 is formed by using the models shown in FIGS. 9 and 20 in combination, following a local feedback removal model. Although the algorithm shown in FIG. 27 is provided by software, the algorithm will be described as a hardware circuit for convenience of description because a function block contained therein carries out an operation equivalent to that of a hardware circuit element.

In FIG. 27, resonance circuits 112 and 114 simulate the vibrations of the lips 3 in the upper model and in the outer model respectively on the basis of the pressure difference signal Ph. Weights of the two models are given by constants u-gain and o-gain given through multipliers 113 and 116, respectively. Various constants used in FIG. 27 are determined by the ALC (see FIG. 29) and supplied to the DSP 9 (details thereof will be described later).

In an adder 150, an offset o-offset is added to the output signal from the multiplier 116. This is because the lips 3 have a considerable opening area at the time of the playing of an acoustic brass instrument even in the case where the pressure difference signal Ph is "0". Then, the output signal from the multiplier 113 and the output signal from the adder 150 are added to each other in an adder 117, so that the addition result is supplied to a slit function table 107. As a result, a slit signal S in which weights of the two models are reflected is outputted from the slit function table 107.

The pressure difference signal Ph is supplied to the function table 124 in the similar manner as described above with reference to FIG. 20, and a signal having a value obtained by dividing a Graham function value corresponding to the pressure difference signal Ph by the pressure difference signal Ph is outputted. This signal is multiplied by the slit signal S through a multiplier 126, and the multiplication result is supplied to a limit circuit 125. A smooth limit function as shown in FIG. 21B is set in the limit circuit 125 in advance.

Then, the output signal from the limit circuit 125 is multiplied by the pressure difference signal Ph through a multiplier 128. The multiplication result is outputted as a flow rate signal f. In an acoustic brass instrument, the flow rate f contains turbulent components. Therefore, in the structure shown in FIG. 27, constituent members 151 to 158 are provided to simulate such turbulent components. The reference numeral 158 designates a random number generator for generating a random number signal. Reference numeral 151 designates a high-pass filter (HPF) for removing DC components from the random number signal. Reference numeral 152 designates a low-pass filter (LPF) which is mainly provided for tone generation and serves to set frequency spectra of the random number signal.

Reference numeral 157 designates a multiplier for multiplying the random number signal by a coefficient r-gain for setting the level of the random number. Reference numeral 153 designates a function table which generates a signal having a value of $|f|^{0.5}$ when the flow rate signal f is given. This signal is multiplied by the random number signal through a multiplier 155. The multiplication result expressing a turbulent component is added to the flow rate signal f through an adder 154. The reason why the function table 153 is provided is as follows.

According to the analysis by the present inventor, the amplitude of the turbulent component is proportional to the square root of the flow rate f.

Then, the flow rate signal f after addition of the turbulent component is multiplied by a constant z through a multiplier 110. The multiplication result is supplied, through an adder 101*a*, to the program for providing the pipe linear portion 102.

C. Operation of the Embodiment

The operation of the embodiment will be described hereunder.

(1) Operation at Key-On Time

In a keyboard type manipulator used in an ordinary electronic musical instrument, a key-on signal is outputted when some key is depressed. In the brass instrument type lip controller 1 used in this embodiment, generation of the key-on signal is not required. Accordingly, the CPU 2 (that is, the ALC 63 in FIG. 29) carries out the following operation when reception of key code related information (mode information, piston information, etc.) is regarded as reception of a key-on signal.

The key code is calculated on the basis of the key code related information. For example, the key code is calculated on the basis of the piston and mode keys by obtaining octave information based on the mode keys and then adding shift information based on the piston keys to the octave information as shown in Table 2.

TABLE 2

| (37, 38, 39) ON = 1, OFF = 0 | 000 | 100 | 010 | 110 | 001 | 101 | 011 | 111 |
|---|---|---|---|---|---|---|---|---|
| KC Shift Down | 0 | −1 | −2 | −3 | −4 | −5 | −6 | −7 |

Then, the CPU 2 calculates a pitch frequency Fp (which is univocally determined on the basis of the key code) corresponding to the calculated key code and then calculates a resonance frequency Fu according to equation (A4). Further, the CPU 2 supplies a delay time $D_{L1}$ corresponding to the key code to the pipe linear portion. In the case where a delay time $D_{L1}'$ is once set by inputting a key code and then another delay time $D_{L1}''$ is supplied by inputting another key code, it is more preferable to afford a portamento effect.

That is, variation of pitch resembling that in an acoustic brass instrument can be provided by slowly changing the delay time $D_{L1}$ from $D_{L1}'$ to $D_{L1}''$. It is a matter of course that the portamento time is preferably shortened in the case where trumpet or the like is simulated, and that the portamento time is preferably elongated in the case where trombone or the like is simulated.

Further, at the key-on time, the characteristics of the LPFs 54 and 59 (see FIG. 31), the output mixture ratio and the like are set corresponding to the key code.

Figure 34:
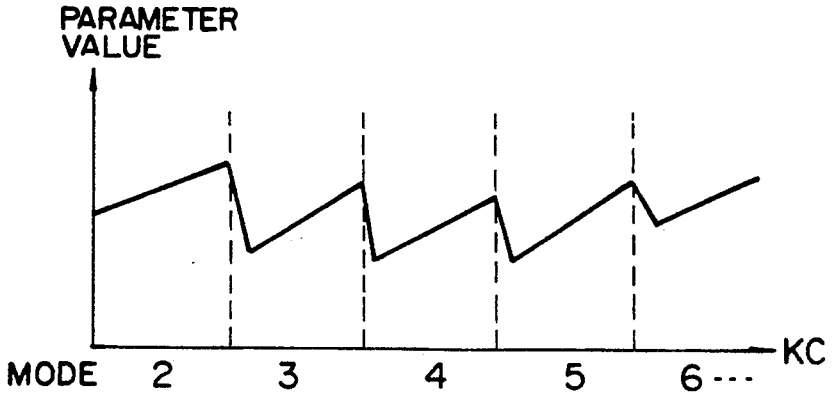
FIG. 34 is a graph showing break points in the brass instrument.

With respect to the key scale, one break point per one octave may be provided. In view of the characteristic of an acoustic brass instrument, break points have steps as shown in FIG. 34. It is therefore preferable that the steps at respective break points are adjusted to coincide with the turning-over of modes. In order to absorb the sudden change of the musical tone at the turning-over of modes by voicing, all parameters subjected to the key scale are changed in the similar manner as described above.

(2) Operation at the Time of Reception of Other Lip Controller Information

The operation upon reception of lip controller information other than the key code related information will be described hereunder. A breathing pressure signal p and an embouchure signal emb, as detected from the pressing force of the lips (see FIG. 26), will be used as lip controller information other than the key code relational information.

When the breathing pressure signal p is received, the CPU 2 multiplies the breathing pressure signal p by a key-scaled constant and gives the multiplication result to the DSP 9.

Figure 35:
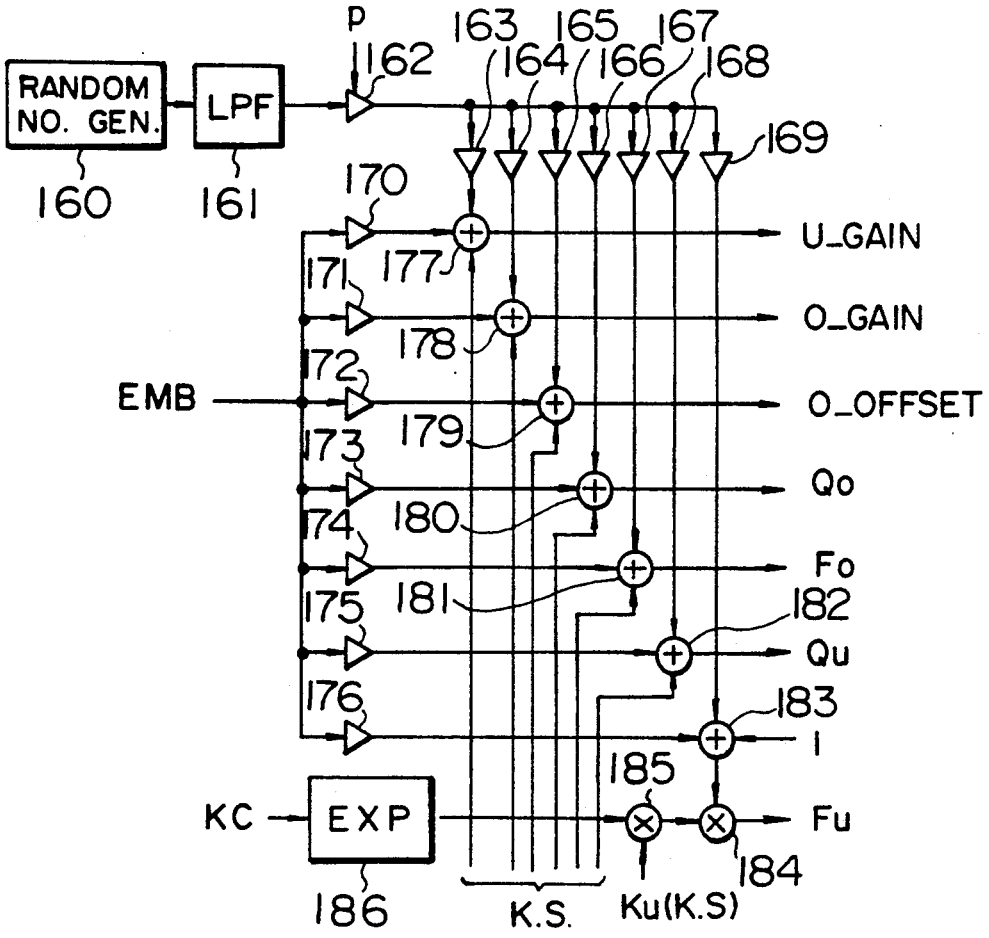
FIG. 35 is a block diagram showing a structure of algorithm of the ALC 63.

When the embouchure signal emb is received, various constants are calculated through the algorithm shown in FIG. 35 and given to the DSP 9. This operation will be described hereunder more in detail.

The embouchure signal emb is multiplied by proportional constants through multipliers 70 to 76. The multiplication results are outputted as constants, u-gain, o-gain, o-offset, Qo, Fo, Qu and Fu through adders 77 to 83. As described above, these constants are supplied to the DSP 9. The proportional constants supplied to the multipliers 70 to 76 are obtained by experiments or the like.

In FIG. 35, "K.S." represents a constant expressing key scaling. These arithmetic operations may be carried out in the DSP side instead of the CPU 2 side.

Before the algorithm in the nonlinear portion receives respective constants, interpolating calculation is applied to the respective constants to provide a smooth change. That is, in the structure shown in FIG. 35, key scaling is applied through the adders 77 to 83 when the respective constants are changed. The constants are outputted with smooth change.

Further, in the structure shown in FIG. 35, a random number signal is generated by the random number generator 60 and supplied to the adders 77 to 83 through the LPF 61, the multiplier 62 and the multipliers 63 to 69. This is for the purpose of providing unstable embouchure of an acoustic brass instrument. Further, in the multiplier 62, the pressure signal p is supplied as a proportional constant. This is because it is general that embouchure becomes more unstable and cause lowering of the stability of pitch as the pressure in the buccal cavity increases.

In the case where the lip controller 1 is used, the pitch information is fixed to "1". When a keyboard or the like is used instead of the lip controller 1, an arbitrary value may be set. In this case, the aforementioned delay times $D_L$ and $D_{L1}$ may be multiplied by the arbitrary value. In acoustic brass instruments, a pitch-bend effect cannot be provided except trombone and the like. By the aforementioned method, a synthesizer-like smooth bend effect or a vibrato effect rich can be provided. In the case where a vibrato effect rich in expression as in acoustic brass instruments is required, it is considered that embouchure modulation is more suitable.

It is a matter of course that the LPF 61 in FIG. 35 may be replaced by a band-pass filter.

(3) Operation in DSP 9

When constants, u-gain, o-gain, o-offset, Qo, Fo, Qu, Fu, etc., are calculated by the CPU 2, the characteristic of the nonlinear portion 100 in the DSP 9 is determined corresponding to these constants. When the breathing pressure signal p is then supplied to the DSP 9, a pressure wave signal propagates through the nonlinear portion 100, the pipe linear portion 102 and the junction 101 to simulate the tone generating mechanism of an acoustic brass instrument. Then, the pressure wave signal is converted into an analog signal through the DAC 10 (see FIG. 1), to generate musical tone through the sound system 11.

D. Modifications

It is a matter of course that the invention is not limited to the aforementioned embodiment and that various modifications may be made such as follows.

D.1 Modification Using LC Emulator (LCE)

Although the aforementioned embodiment is described on the case where the lip controller 1 limitating an acoustic brass instrument is used, the invention can be applied to the case where the lip controller 1 may be replaced by an ordinary keyboard. In this case, output signals from the keyboard need be changed to emulate signals outputted from the lip controller. The output signals from the keyboard mainly include a key-on signal, a key-off signal and a key code signal but do not include a breathing pressure signal p, an embouchure signal emb, etc. The keyboard may include various manipulators such as modulators, bend wheels, pedals, etc. It is more preferable that the performance emulation can be done without use of these manipulators.

(1) Envelope Generating Method

Figure 36:
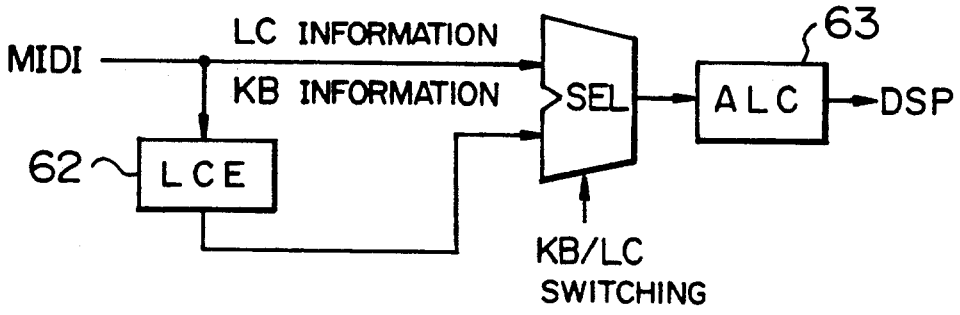
FIG. 36 is a block diagram of a control program set in the ROM 4.

The relation between the LCE 62 and the ALC 63 is shown in FIG. 36. As the input signal to the ALC 63, either of the output from the lip controller and the output from the LCE 62 is selected. The LCE 62 emulates four kinds of information, that is, piston information, mode key information, breathing pressure signal p and embouchure signal emb, which will be outputted from the ALC 63.

Figure 37:
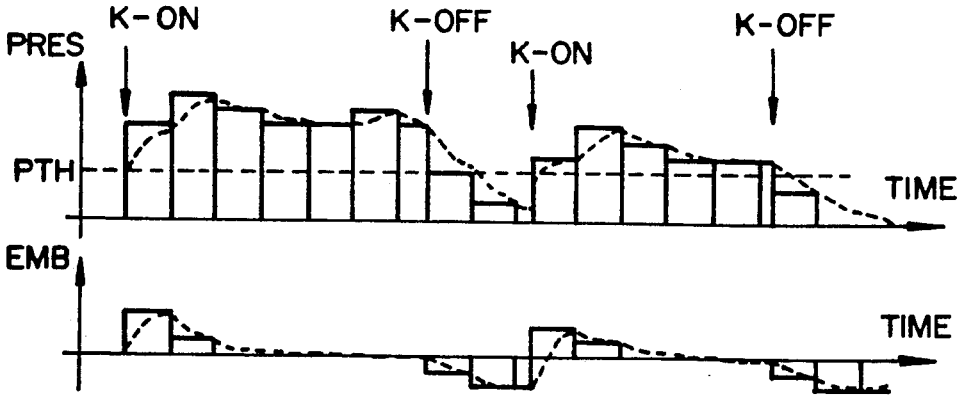
FIG. 37 is a graph showing the operation of the LCE 62.

FIG. 37 is a graph showing the relations between the envelope signals generated by the LCE 62, i.e. the breathing pressure signal p and the embouchure signal emb. In FIG. 37, the step-like solid line expresses the waveform of the envelope signal generated by the LCE 62, and the broken line expresses the waveform of the envelope signal given to the ALC 63 after interpolation by hardware (interpolator is provided prior to the algorithm in the hardware side).

When a key-on event occurs, the LCE 62 is driven periodically. The driving period is generally from about 2 msec to about 8 msec. As described above, an insensible zone exists at the time of the starting of the breathing pressure signal p. Therefore, the breathing pressure signal p is started while an interpolating constant in hardware is set to "0" before the level of the signal reaches the threshold $p_{th}$. When the signal level reaches the threshold $p_{th}$, the interpolating constant is set to an ordinary interpolating rate. As a result, the state of the envelope is successively changed according to ADSR (attack, decay, sustain, and release). Because the breathing pressure signal p controls acoustic volume, the rate and level in the attack portion of the envelope are controlled on the basis of velocity information and manipulator information. Similarly, the change rate and the level of envelope in the sustain portion are controlled by the manipulation of pedals and after-touch.

The reason why the envelope for embouchure emb is started from a slightly positive (in a direction of narrowing lips) value is as follows. In view of the nature of the algorithm, a smooth attack portion can be formed by starting the envelope from a somewhat small value of o-offset. Also in this respect, it is more preferable that the change rate and the level of envelope in the attack portion can be controlled through touch, manipulators, and the like. When a key-off signal is then received, the period is reset to shift the state of the envelope to a release state as soon as possible. Then, the LCE 62 is driven periodically until the tone disappears. The periodical driving of the LCE 62 may be continued before the next key-on event occurs or may be stopped when the tone level decreases to a predetermined a small value. Although FIG. 37 shows the case where the embouchure emb is offset at the release time in a direction reverse to the direction at the attack time, it is to be understood that this is merely shown as an example of playing expression and is not essential.

(2) Method of Generating Breathing Pressure Signal p, Embouchure emb and Pitch Information If the breathing pressure signal p and the embouchure emb are moved only by the respective envelopes determined on the basis of the key-on velocity, the resulting musical tone is inclined to be monotonous. Accordingly, it is more preferable that the musical tone is modified by after-touch information, modulation, pedal information, etc. An example of modification of the musical tone is shown in FIG. 38.

Figure 38:
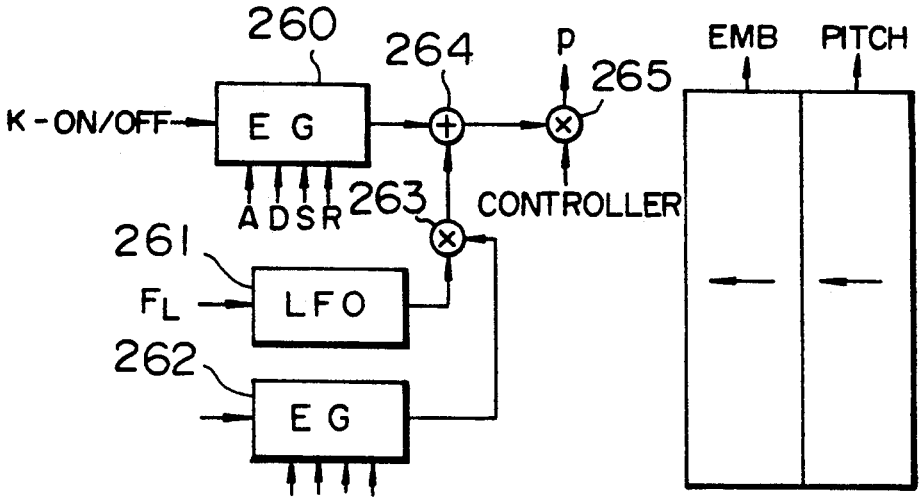
FIGS. 38 to 40 are schematic diagrams showing other embodiments of the invention.

In FIG. 38, an offset is added to the output signal from an envelope generator 60 by the output of a manipulator (which is not shown) supplied through a low-frequency oscillator 61 and an envelope generator 62. It is more preferable that the output signal from the low-frequency oscillator 61, parameters in the envelope generator 62, and the like, can be changed by manipulators. With respect to the breathing pressure signal p, the embouchure emb and the pitch information, an envelope can be generated substantially in a similar manner as described above.

Figure 39:
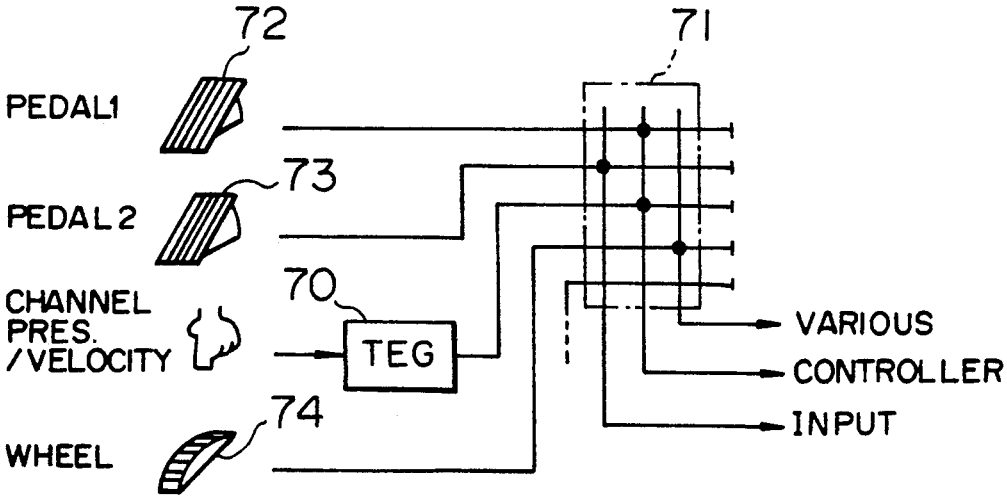

Input signals generated from arbitrary controllers may be selected so that various controllers can be used in various combinations as shown in FIG. 39. In FIG. 39, reference numeral 71 designates an addition matrix circuit, and a circled cross mark in each intersection represents an addition point. The addition matrix circuit is arranged so that manipulation information from various manipulators 72 to 74 has influence on the musical tone and that manipulators affecting the musical tone can be selected suitably. In the circuit shown in FIG. 39, a touch envelope generator (TEG) 70 serves a similar role as the manipulators 72 to 74.

Figure 40:
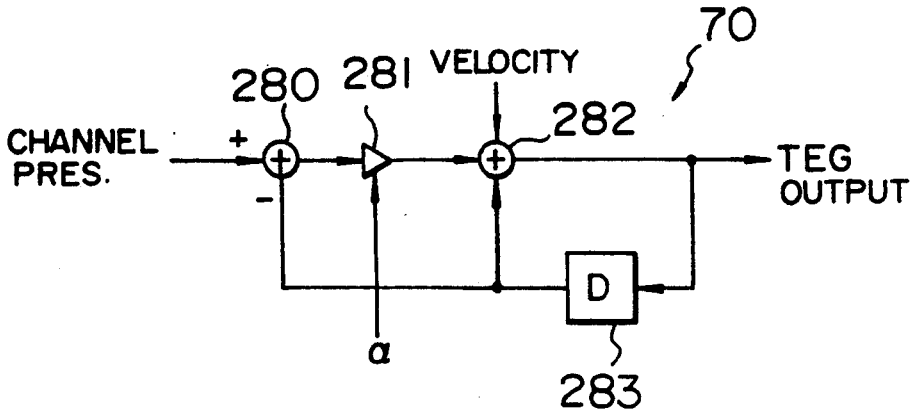

A structure of the TEG 70 is shown in FIG. 40. In FIG. 40, reference numerals 80 and 82 designate adders, 81 a multiplier, and 83 a delay circuit. An interpolating constant $\alpha$ is supplied to the multiplier 81. Preferably, the interpolating constant $\alpha$ takes a smaller value during the period of about 100 msec after the key on event and then takes a larger value to follow after-touch. The delay time in the delay circuit 83 is preferably set to a range of from the order of msec to the order of tens of msec.

D.2 Other Modifications

Figure 32:
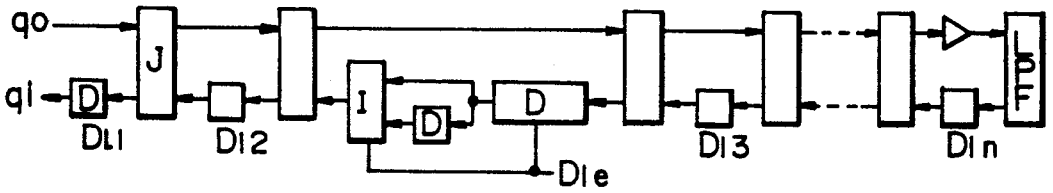
Figure 33:
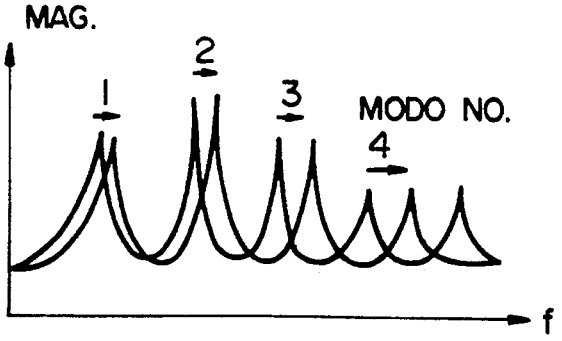
FIG. 33 is a graph showing the method of tuning the linear pipe portion 102.

The delay circuit 58 in FIG. 31 may be replaced by a filter including an inductance element. Alternatively, the delay circuit in each of FIGS. 31 and 32 may be replaced by an all-pass filter. Harmonies in the respective modes are shifted by the aforementioned structure. Accordingly, harmonic components in oscillation waveform are disordered from the mode of the pipe when oscillation is made in a specific mode. As a result, the tone color of the resulting musical tone becomes dark because the musical tone contains little harmonic components. In acoustic brass instruments such as horn, a peculiar tone color may be generated by reduction of harmonic components because of the same phenomenon. Accordingly, such a tone color in brass instruments can be reproduced faithfully.

What is claimed is:

1. A tone signal synthesizer comprising:

loop circuit means for circulating a signal, said loop circuit means including delay means for delaying said signal;

pressure difference means for receiving a breath pressure signal and a loop pressure signal and for outputting a difference signal corresponding to a difference between said breath pressure signal and said loop pressure signal;

resonance means including a first and a second circuit, which constitutes part of said loop circuit, said first circuit including absolute value means for generating an absolute value signal indicative of an absolute value of said difference signal, non-linear circuit means for processing said difference signal and said absolute value signal in accordance with at least one non-linear function, and combining means for combining the processed difference signal and the processed absolute value signal to produce a first signal, and said second circuit generating a second signal which becomes larger as said difference signal becomes larger;

transmission means for generating a transmission signal based on said first and second signals, said transmission signal being provided to said loop circuit means for circulation therein.

2. A tone signal synthesizer according to claim 1, wherein said first circuit includes a first resonance circuit having a high resonance frequency, and said second circuit includes a second resonance circuit having a low resonance frequency.

3. A tone signal synthesizer according to claim 1, wherein the loop circuit means includes an averaging circuit for neglecting short time change of said breath pressure signal.

4. A tone signal synthesizer according to claim 1, wherein the loop circuit includes a DC filter for removing high frequency components of said breath pressure signal.

5. A tone signal synthesizer according to claim 1, further comprising a third circuit for producing a third signal representing a Graham function in response to said difference, said transmission means generating said transmission signal beased on said first, second and third signals.

6. A tone signal synthesizer according to claim 5, wherein said third circuit includes a limiter circuit for limiting a rate of change with which an output signal becomes larger as an input signal becomes larger.

7. A tone signal synthesizer according to claim 1, wherein said first circuit includes an offset circuit for adding an offset value.

8. A tone signal synthesizer according to claim 1, further comprising:

embouchure means for generating an embouchure signal representing an embouchure; and changing means for changing characteristics of said first and second circuits on the basis of said embouchure signal.

9. A tone signal synthesizer according to claim 8, further comprising a random number generator for generating a random number signal representing random numbers to said changing means, wherein said characteristics of said first and second circuits are changed on the basis of said random number signal.

10. A tone signal synthesizer according to claim 9, further comprising an amplifying circuit for amplifying said random number signal in accordance with said breath pressure signal.

11. A tone signal synthesizer according to claim 1, further comprising:

a keyboard for generating a touch signal representing a degree of touch thereon; and a circuit for generating said breath pressure signal on the basis of said touch signal.

12. A tone signal synthesizer according to claim 10, further comprising:

a keyboard for generating a touch signal representing a degree of touch thereon; and a circuit for generating said breath pressure signal on the basis of said touch signal.

13. A tone signal synthesizer according to claim 12, further comprising:

at least one pedal for generating a pedal output signal corresponding to depth of pressing of said pedal; and a circuit for generating an embouchure signal corresponding to said pedal output signal.

14. A tone synthesizer comprising:

breath pressure detection means for detecting a breath pressure;

pressing force detection means for detecting a pressing force;

loop circuit means having a delay for synthesizing a tone signal, the loop circuit controlling the synthesis of the tone signal in accordance with the detected breath pressure and pressing force;

frequency control means for increasing a frequency of the tone signal to be synthesized in accordance with said detected pressing force;

random component addition means for adding a random number component to said frequency of said tone signal; and random number control means for increasing said random number component in accordance with said detected breath pressure.

15. A tone synthesizer according to claim 14, further comprising a performance manipulator for use by a player in applying the breath pressure and the pressing force, the pressing force being applied with a lip of the player.

16. A tone synthesizer comprising:

a performance manipulator for use by a player in applying a breath pressure of said player and a pressing force with a lip of said player;

breath pressure detection means for detecting said breath pressure;

pressing force detection means for detecting said pressing force;

first resonance means for receiving an input signal and generating a first resonance signal having a resonant frequency corresponding to a pitch of a musical tone which changes in accordance with said detected breath pressure and said detected pressing force; and delay means for delaying said first resonance signal and for feeding said delayed first resonance signal back to said first resonance means as said input signal.

17. A tone synthesizer according to claim 16, wherein said first resonance means includes a second resonance means having a low resonance frequency compared to that of said musical tone.

18. A tone signal synthesizer comprising:

loop circuit means for circulating a signal, said loop circuit means including at least one of delay means for delaying said signal and multiplying means for multiplying said signal by a predetermined value;

pressure difference means for receiving a breath pressure signal and a loop pressure signal and for outputting a difference signal corresponding to a difference between said breath pressure signal and said loop pressure signal;

resonance means including a first and a second circuit, said first circuit including absolute value means for generating an absolute value signal indicative of an absolute value of said difference signal, combining means for combining the difference signal and the absolute value signal and producing a combined difference signal, and non-linear circuit means for processing the combined difference signal in accordance with a non-linear function to produce a first signal, said second circuit generating a second signal which becomes larger as the value of said difference signal becomes larger; and transmission means for generating a transmission signal based on said first and second signals, said transmission signal being provided to said loop circuit means for circulation therein.

* * * * *